US006020118A

United States Patent [19]

Hashi et al.

[11] Patent Number: 6,020,118

[45] Date of Patent: Feb. 1, 2000

[54] SILVER HALIDE PHOTOGRAPHC MATERIAL

[75] Inventors: Yoshihisa Hashi; Kazuaki Miyashita; Junichi Yamanouchi, all of Kanagawa, Japan

[73] Assignee: Fuji Photo Film Co., Ltd., Minami-ashigara, Japan

[21] Appl. No.: 08/949,615

[22] Filed: Oct. 14, 1997

[30] Foreign Application Priority Data

Oct. 15, 1996 [JP] Japan ..... 8-293335
Mar. 6, 1997 [JP] Japan ..... 9-069144

[51] Int. Cl.[7] ..... G03C 1/005; G03C 5/16

[52] U.S. Cl. ..... 430/567; 430/569; 430/966

[58] Field of Search ..... 430/567, 569, 430/966, 627

[56] References Cited

U.S. PATENT DOCUMENTS 5,439,787 8/1995 Yamanouchi et al. ..... 430/567
5,541,047 7/1996 Kashiwagi et al. ..... 430/567
5,567,580 10/1996 Fenton et al. ..... 430/567

*Primary Examiner*—John A. McPherson
*Attorney, Agent, or Firm*—Burns, Doane, Swecker & Mathis, LLP

[57] ABSTRACT

A silver halide photographic material has at least one photosensitive silver halide emulsion layer and at least one non-photosensitive hydrophilic colloid layer on a support. The silver coverage per surface is 1.0–2.2 g/m$^2$. The silver halide emulsion layer contains silver halide grains wherein tabular silver halide grains having an aspect ratio of at least 5 account for at least 50% of the entire projected area of silver halide grains. The silver halide grains have been grown on pure silver bromide or silver chlorobromide grains as nuclei so as to form silver iodobromide or silver chlor-oiodobromide having a silver iodide content of 0.1–3.20 mol % at the end of growth. This X-ray photosensitive material having high sensitivity and sharpness is used with a regular screen.

10 Claims, No Drawings

SILVER HALIDE PHOTOGRAPHC MATERIAL

BACKGROUND OF THE INVENTION

This invention relates to a photographic silver halide photosensitive material and more particularly, to a medical radiographic photosensitive material exhibiting high sensitivity and sharpness when combined with a fluorescent screen having a peak luminous wavelength in the range of 300 to 500 nm.

High sensitivity techniques utilizing tabular silver halide grains were recently disclosed. Most medical photographic materials taking advantage of such tabular silver halide grains are those photosensitive materials which are combined with a fluorescent screen utilizing GdOS and thus designed so as to achieve a maximum sensitivity to green light emission. However, there are known inexpensive fluorescent substances having a luminous peak in the range of 300 to 500 nm and fluorescent substances featuring high luminance. When medical X-ray photosensitive materials are subject to rapid processing after exposure using such screens, these materials are still insufficient with respect to sensitivity, graininess and sharpness.

There is a need from the medical side for a medical X-ray photosensitive material which exhibits high sensitivity, graininess and sharpness even when combined with such screens and subject to rapid processing.

There is known an attempt to cut off crossover light using a water-soluble dyestuff. As photosensitive material is repeatedly contacted with a screen, the dyestuff is transferred to the screen, inviting undesirable desensitization. Under the circumstances, there is a need for a medical X-ray photosensitive material which exhibits high sensitivity and sharpness and which does not soil a screen.

SUMMARY OF THE INVENTION

A first object of the present invention is to provide a silver halide photographic material, especially medical X-ray photosensitive material which is improved in sensitivity, graininess and sharpness and free of dye stain even when combined with a screen having a luminous peak in the range of 300 to 500 nm and subject to rapid processing.

A second object of the present invention is to provide a silver halide photographic material, especially medical X-ray photosensitive material which is improved in sensitivity and sharpness even when combined with a screen having a luminous peak in the range of 300 to 500 nm and which does not soil the screen.

According to a first aspect of the invention, there is provided a silver halide photographic material comprising at least one photosensitive silver halide emulsion layer and at least one non-photosensitive hydrophilic colloid layer on a support. The silver coverage per surface is in the range of 1.0 to 2.2 g/m$^2$. The silver halide emulsion layer contains silver halide grains wherein tabular silver halide grains having an aspect ratio of at least 5 account for at least 50% of the entire projected area of silver halide grains. The silver halide grains have been grown on pure silver bromide grains or silver chlorobromide grains as nuclei so as to form silver iodobromide or silver chloroiodobromide having a silver iodide content of 0.1 to 3.20 mol % at the end of growth.

Preferably, the pure silver bromide grains or silver chlorobromide grains serving as nuclei have been prepared using a polymer having recurring units of the following formula (1):

$$-(R-O)_n- \quad (1)$$

wherein R is an alkylene group having 3 to 10 carbon atoms and letter n representative of an average number of recurring units is 4 to 200.

Preferably, the polymer having recurring units of formula (1) is a vinyl polymer having recurring units derived from at least one monomer of the following formula (2):

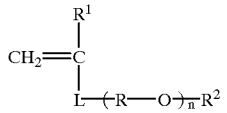

(2)

wherein R is an alkylene group having 3 to 10 carbon atoms, letter n representative of an average number of recurring units is 4 to 200, $R^1$ is hydrogen or a lower alkyl group, $R^2$ is hydrogen or a monovalent substituent, and L is a divalent linkage group.

Upon exposure of the photographic material, a screen having a luminous wavelength in the range of 300 to 500 nm is typically used. Preferably, the silver halide grains have been sensitized with selenium.

In another embodiment of the invention, a silver halide photographic material has at least one photosensitive silver halide emulsion layer and at least two non-photosensitive hydrophilic colloid layers on a support. Upon exposure of the photographic material, a screen having a luminous wavelength in the range of 300 to 500 nm is used. The silver halide emulsion layer contains silver halide grains wherein tabular silver halide grains having an aspect ratio of at least 5 account for at least 50% of the entire projected area of silver halide grains. The silver halide grains have been spectrally sensitized with at least one compound of the general formula (I):

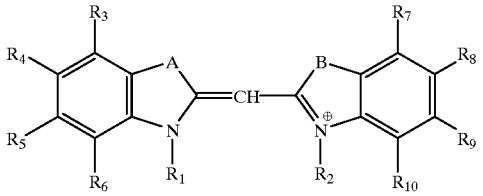

(I)

wherein each of A and B is an oxygen atom, sulfur atom or imino group, each of $R_1$ and $R_2$ is a sulfoalkyl group, and $R_3$ to $R_{10}$ are independently selected from the class consisting of hydrogen, halogen, alkyl, alkenyl, alkoxy, aryl and heterocyclic groups. At least one non-photosensitive hydrophilic colloid layer using a solid particle dispersion of a dyestuff is coated under the photosensitive silver halide emulsion layer. Preferably, the silver halide grains have been sensitized with selenium.

Preferably, the solid particle dispersion of a dyestuff is a solid particle dispersion of a dyestuff of the general formula (FA):

$$D-(X)_{y1} \quad (FA)$$

wherein D is a group derived from a compound having a chromophore, X is dissociatable proton directly bonding to D, a group having such dissociatable proton, dissociatable proton having attached thereto a divalent linkage group bonding to D or a group having such dissociatable proton, and letter y1 is an integer of 1 to 7.

More preferably, the dyestuff of formula (FA) is a dyestuff of the following formula (FA1), (FA2) or (FA3):

$$A_1{=}L_1{-}(L_2{=}L_3)_{p1}{-}Q \quad \text{(FA1)}$$

$$A_1{=}L_1{-}(L_2{=}L_3)_{p2}{-}A_2 \quad \text{(FA2)}$$

$$A_1{=}L_1{-}(L_2{=}L_3)_{p3}{-}B_1 \quad \text{(FA3)}$$

wherein each of $A_1$ and $A_2$ is an acidic nucleus, $B_1$ is a basic nucleus, Q is an aryl or heterocyclic group, each of $L_1$, $L_2$ and $L_3$ is a methine group, letter p1 is equal to 0, 1 or 2, each of letters p2 and p3 is equal to 0, 1, 2 or 3, with the proviso that the compounds of formulae (FA1) to (FA3) have in a molecule at least one group selected from the class consisting of a carboxylic acid group, sulfonamide group, arylsulfamoyl group, sulfonylcarbamoyl group, carbonylsulfamoyl group, enol group of an oxanol dye, and phenolic hydroxyl group, but are free of any water-soluble group other than that.

BENEFITS

The silver halide photographic material according to the invention includes at least one photosensitive silver halide emulsion layer on a support. The silver halide emulsion layer contains silver halide grains wherein tabular silver halide grains having an aspect ratio of at least 5 account for at least 50% of the entire projected area of silver halide grains. This emulsion has high sensitivity and covering power, as compared with emulsions wherein tabular silver halide grains having an aspect ratio of less than 5 account for at least 50% of the entire projected area. In the photosensitive material, the silver coverage per surface is in the range of 1.0 to 2.2 g/m$^2$. The silver halide grains are obtained by growing from pure silver bromide or silver chlorobromide grains as nuclei so as to form silver iodobromide or silver chloroiodobromide having a silver iodide content of 0.1 to 3.20 mol % at the end of growth. Then images having high sensitivity, improved sharpness and minimized unsharpness are obtained without dye stain. These advantages are obtained even when a screen having a luminous peak in the range of 300 to 500 nm is utilized.

With a silver coverage of less than 1.0 g/m$^2$, sharpness and sensitivity are lost. Dye stain occurs with a silver coverage of more than 2.2 g/M$^2$. With a silver iodide content of less than 0.1 mol %, sharpness is lost whereas dye stain occurs with a silver iodide content of more than 3.20 mol %.

If a silver iodide content within the scope of the invention is accomplished using iodine-containing nuclei rather than pure silver bromide grains and silver chlorobromide grains, then there result grains having an increased thickness and reduced covering power.

According to the invention, a further improvement in sensitivity is achieved by performing nucleation using a polymer having recurring units of formula (1). Even when a polymer having recurring units of formula (1) is used in nucleation, the presence of iodine during nucleation can result in grains having an increased thickness and reduced covering power.

In one preferred embodiment, the silver halide photographic material includes at least one photosensitive silver halide emulsion layer and at least two non-photo-sensitive hydrophilic colloid layers on a support. The silver halide grains are spectrally sensitized with a compound of formula (I). A non-photosensitive hydrophilic colloid layer using a solid particle dispersion of a dyestuff is coated under the emulsion layer.

The photosensitive material of the preferred embodiment ensures that images having high sensitivity and improved sharpness are obtained even when combined with a screen having a luminous peak in the range of 300 to 500 nm. That is, the use of a dye of formula (I) leads to higher sensitivity and sharpness. Sharpness is improved by containing a solid particle dispersion of a dyestuff in the non-photosensitive hydrophilic colloid layer. By adding a solid particle dispersion of a dyestuff to a non-photo-sensitive hydrophilic colloid layer above the emulsion layer, the staining of the screen is suppressed. When a solid particle dispersion of a dyestuff is added to a non-photosensitive hydrophilic colloid layer below the emulsion layer, the staining of the screen is retarded by the fixation of the dyestuff as compared with the addition of a dyestuff with the aid of a solvent. There would be obtained additional advantages including safe light tolerance and shelf stability of the photosensitive material.

The non-photosensitive hydrophilic colloid layers used herein are an undercoat layer, surface protective layer and the like. The non-photosensitive hydrophilic colloid layer that becomes a dyestuff layer under the emulsion layer is preferably an undercoat layer coated between the support and the emulsion layer. This will be described later.

DESCRIPTION OF THE PREFERRED EMBODIMENTS

Photographic material

With respect to the halogen composition of silver halide grains used herein, either silver halide of silver iodobromide and silver iodochlorobromide may be used. The silver halide grains are characterized by a higher iodine content on the shell side since silver bromide grains or silver chlorobromide grains are used as nuclei or cores. Preferred nuclei or cores are silver chlorobromide grains having a silver chloride content of less than 20 mol % or pure silver bromide grains. The use of pure silver bromide grains is especially preferred.

After grains are grown from the above-mentioned nuclei or seed crystals, the grains should preferably have an average iodine content of 0.1 to 3.20 mol %, more preferably 0.5 to 2.5 mol % and an average silver chloride content of 0 to 10 mol % at the end of growth.

With respect to the shape of silver halide grains, tabular grains having an average aspect ratio of at least 5 are most preferred. By the term "aspect ratio" is meant a ratio of diameter to thickness of a grain. The diameter is a diameter of a circle having an area equal to the projected area of a tabular silver halide grain and the thickness is the distance between two parallel surfaces of the tabular silver halide grain. The upper limit of aspect ratio is not particularly limited although it is usually about 20.

The silver halide grains used herein preferably have a diameter of at least 0.8 $\mu$m, more preferably 1 to 2 $\mu$m, calculated as a circle equivalent grain size based on the projected area of grains, and a thickness of 0.05 to 0.4 $\mu$m, more preferably 0.1 to 0.3 $\mu$m.

In a layer containing tabular silver halide grains according to the invention, those tabular silver halide grains having an aspect ratio of at least 5 account for 50% to 100%, preferably 60% to 100%, more preferably 70% to 100% of the entire projected area of silver halide grains.

According to the invention, the silver coverage per surface is in the range of 1.0 to 2.2 g/m$^2$, preferably 1.3 to 2.0 g/m$^2$.

More preferably, the emulsion is coated on a mordant layer as described in JP-A 68539/1990 and 24539/1991.

The silver bromide grains or silver chlorobromide grains serving as nuclei are preferably prepared by mixing a polymer having recurring units of the general formula (1) in a gelatin solution and processing by the double-jet method. The amount of the polymer added to the gelatin solution is not critical although it is preferably 0.1 to 20 g per mol of silver.

Described below is the polymer having recurring units of the general formula (1) often used in the preparation of the silver halide emulsion according to the invention.

The preferred polymer used in forming pure silver bromide grains or silver chlorobromide grains serving as nuclei is a polymer having recurring units of the general formula (1):

$$—(R—O)_n— \quad (1)$$

wherein R is an alkylene group having 3 to 10 carbon atoms and letter n representative of an average number of recurring units is 4 to 200.

More specifically, the alkylene groups of 3 to 10 carbon atoms represented by R include $—CH(CH_3)CH_2—$, $—CH_2CH(CH_3)—$, $—CH_2CH_2CH_2—$, $—CH_2CH(OH)CH_2—$, $—(CH_2)_4—$, and $—(CH_2)_5—$, with the $—CH(CH_3)CH_2—$ and $—CH_2CH(CH_3)—$ being preferred.

Letter n representative of an average number of recurring units is 4 to 200, preferably 4 to 50, more preferably 6 to 50.

In forming the emulsion according to the invention, any polymer may be preferably used insofar as it contains recurring units of formula (1). More preferred are vinyl polymers having recurring units derived from a monomer of the following general formula (2) and polymers of the following general formula (3), and block polymers of polyalkylene oxide of the following formula (4) and polyalkylene oxide of the following formula (5), with the vinyl polymers having recurring units derived from a monomer of formula (2) being especially preferred.

(2)

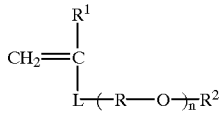

(2)

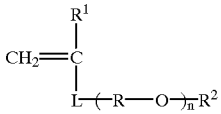

(3)

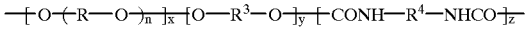

(4)

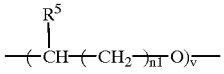

(5)

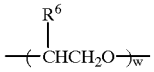

Formula (2) is first described. In formula (2), R and n are as defined in formula (1), $R^1$ is hydrogen or a lower alkyl group, $R^2$ is hydrogen or a monovalent substituent, and L is a divalent linkage group.

More specifically, $R^1$ is hydrogen or a lower alkyl group having 1 to 4 carbon atoms such as methyl, ethyl, n-propyl and n-butyl, with the hydrogen atom and methyl group being preferred.

$R^2$ is hydrogen or a monovalent substituent which is preferably a monovalent substituent having up to 20 carbon atoms. Illustratively, $R^2$ is a hydrogen atom, a substituted or unsubstituted alkyl group having 1 to 20 carbon atoms (e.g., methyl, ethyl, isopropyl, n-hexyl, n-dodecyl, benzyl, 2-cyanoethyl, 2-chloroethyl, 3-methoxypropyl, 4-phenoxybutyl, 2-carboxyethyl, $—CH_2CH_2SO_3Na$, and $—CH_2CH_2NHSO_2CH_3$), a substituted or unsubstituted aryl group (e.g., phenyl, p-methylphenyl, p-methoxyphenyl, o-chlorophenyl, p-octylphenyl, and naphthyl), an acyl group (e.g., acetyl, propionyl, benzoyl, and octanoyl) or a carbamoyl group (e.g., $—CONHCH_3$, $—CON(CH_3)_2$, and $—CONHC_6H_{13}$). Preferred are hydrogen, methyl, ethyl, phenyl and acetyl.

L is a divalent linkage group, preferably a group of the following general formula (6) or (7).

$$—CO—X^1—L^1—X^2— \quad (6)$$

In formula (6), $X^1$ is an oxygen atom or $—NR^6—$ wherein $R^6$ is hydrogen, a substituted or unsubstituted alkyl group, a substituted or unsubstituted aryl group, a substituted or unsubstituted acyl group or a group $—L^1—X^2—(R—O)_n—R^2$. Preferably $R^6$ is hydrogen, a substituted or unsubstituted alkyl group of 1 to 10 carbon atoms (e.g., methyl, ethyl, n-butyl and n-octyl), an acyl group (e.g., acetyl and benzoyl) or a group $—L^1—X^2—(R—O)_n—R^2$. $R^2$ is as defined in formula (2). Most preferably, $X^1$ is an oxygen atom or —NH—.

$L^1$ is a valence bond, a substituted or unsubstituted alkylene group (e.g., dimethylene, trimethylene, tetramethylene, decamethylene, methyldimethylene, phenyldimethylene, $—CH_2(C_6H_4)CH_2—$, and $—CH_2CH_2NHCOOCH_2—$) or a substituted or unsubstituted arylene group (e.g., o-phenylene, m-phenylene, p-phenylene, and methylphenylene). Preferably, $L^1$ is a valence bond or $—(CH_2)_k—$ wherein k is an integer of 3 to 12.

$X^2$ is a valence bond, an oxygen atom, —COO—, —OCO—, $—CONR^6—$, $—NR^6CO—$, —OCOO—, $—NR^6COO—$, $—OCONR^6—$ or $—NR^6—$ wherein $R^6$ is as defined above. Preferably, $X^2$ is a valence bond, an oxygen atom, —COO—, —CONH—, —NHCOO— or —NHCONH—.

(7)

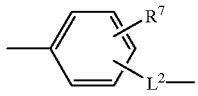

In formula (7), $R^7$ is a hydrogen atom, a halogen atom, a substituted or unsubstituted alkyl group or a substituted or unsubstituted acyl group. Preferably $R^7$ is hydrogen, chlorine, a lower alkyl group having up to 6 carbon atoms or a lower acyl group, with the hydrogen and methyl being especially preferred. $L^2$ is a valence bond, $—L^1—$, $—X^2—$, $—L^1—X^2—$, $—X^1—L^1—X^2—$ or $—CO—X^1—L^1—X^2—$ wherein $X^1$, $X^2$ and $L^1$ are as defined above. Preferably $L^2$ is $—L^1—$, $—X^2—$ or $—L^1—X^2—$, especially $—CH_2O—$, —COO—, —CONH— or —O—.

Recurring units represented by R—O may be of one type in a monomer. A copolymerized form containing such recurring units of two or more types is also acceptable.

Letter n representative of an average molar number of recurring units is 4 to 200, preferably 4 to 50, more preferably 6 to 40.

Preferred, non-limiting, examples of the monomer of formula (2) are given below.

MP-1~5
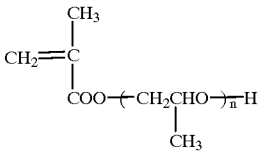
MP-1 n = 6
MP-2 n = 9
MP-3 n = 12
MP-4 n = 20
MP-5 n = 40
MP-6~8
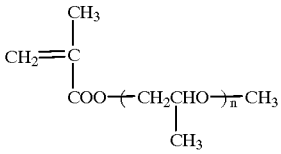
MP-6 n = 4
MP-7 n = 12
MP-8 n = 30
MP-9
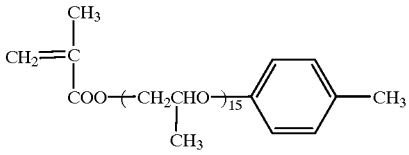
MP-10, 11
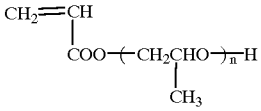
MP-10 n = 6
MP-11 n = 18
MP-12
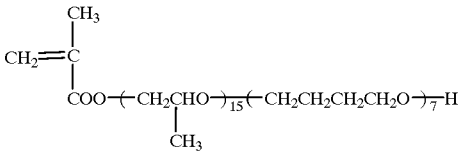
MP-13
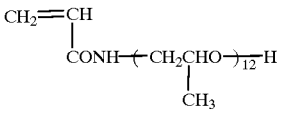
MP-14, 15
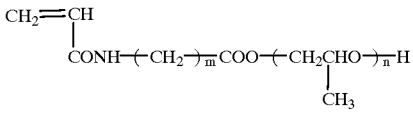
MP-14 m = 5, n = 25
MP-15 m = 3, n = 12
MP-16, 17
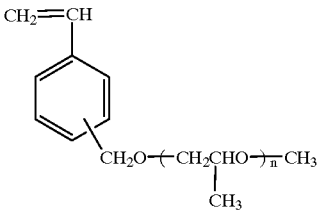
MP-16 n = 8
MP-17 n = 20
MP-18
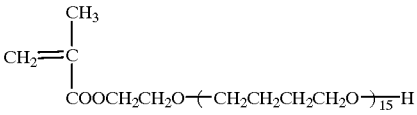
MP-19
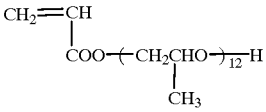

Preferred vinyl polymers are copolymers of a monomer of formula (2) with another copolymerizable monomer.

Examples of the copolymerizable monomer include acrylates, methacrylates, acrylamides, methacrylamides, vinyl esters, vinyl ketones, allyl compounds, olefins, vinyl ethers, N-vinylamides, vinyl heterocyclic compounds, maleates, itaconates, fumarates, and crotonates. More illustrative examples are:

methyl acrylate, ethyl acrylate, n-propyl acrylate, n-butyl acrylate, sec-butyl acrylate, octyl acrylate, diethylene glycol monoacrylate, trimethylol ethane monoacrylate, 1-bromo-2-methoxyethyl acrylate, p-chlorophenyl acrylate, methyl methacrylate, and ethyl methacrylate, hydrophobic monomers whose homopolymers are water insoluble, for example, N-tert-butyl acrylamide, hexyl acrylamide, octyl acrylamide, ethyl vinyl ether, propyl vinyl ether, butyl vinyl ether, 2-ethylbutyl vinyl ether, vinyl acetate, vinyl propionate, ethylene, propylene, 1-butene, 1-octene, dioctyl itaconate, dihexyl maleate, styrene, methylstyrene, dimethylstyrene, benzylstyrene, chloromethylstyrene, chlorostyrene, methyl vinylbenzoate, vinyl chlorobenzoate, acrylonitrile, methacrylonitrile, and vinyl chloride, acrylamide, N-methylacrylamide, N-ethylacrylamide, N-n-propylacrylamide, N-isopropylacrylamide, N,N-dimethylacrylamide, N-acryloylmorpholine, N-acryloylpiperidine, methacrylamide, N-methylmethacrylamide, N-methacryloylmorpholine, N-vinylpyrrolidone, and N-vinylacetamide, monomers whose homopolymers are water soluble, for example, COOH containing monomers such as acrylic acid, methacrylic acid, itaconic acid, and maleic anhydride, and monomers having another anionic dissociatable group such as 2-acrylamido-2-methylpropanesulfonic acid and salts thereof, sodium p-styrenesulfonate, and phosphonoethyl methacrylate.

Other useful monomers are given below.

ME-1~5

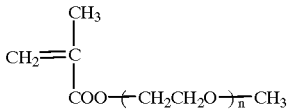

ME-1 n = 4
ME-2 n = 9
ME-3 n = 15
ME-4 n = 23
ME-5 n = 50

ME-6, 7

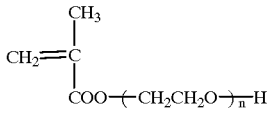

ME-6 n = 6
ME-7 n = 20

ME-8, 9

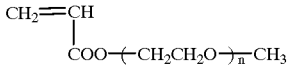

ME-8 n = 9
ME-9 n = 30

ME-10

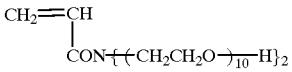

ME-11

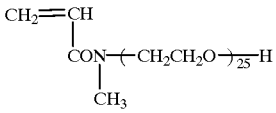

ME-12~14

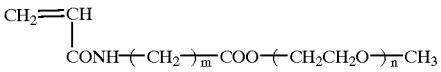

ME-12 m = 1, n = 20
ME-13 m = 3, n = 15
MP-14 m = 10, n = 30

MP-15, 16

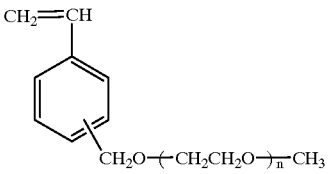

ME-15 n = 8
ME-16 n = 15

MP-17

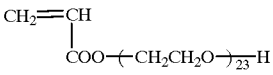

MP-18

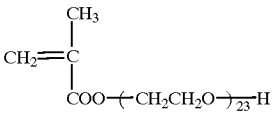

The monomers of formula (2) and other ethylenically unsaturated monomers may be respectively used in admixture of two or more.

The polymer having recurring units of formula (1) is desirably soluble in a medium in which tabular grains are formed and hence, preferably soluble in a water-soluble medium. The polymer should preferably be soluble in either water or a mixture of water and a water-miscible organic solvent.

The measure of water-solubility of the polymer according to the invention is that at least 1% by weight of the polymer is soluble in distilled water or a mixture of distilled water and methanol in a weight ratio 9:1 at room temperature (25° C.).

Of the vinyl polymer according to the invention, the monomer units of formula (2) constitute 1 to 90% by weight, preferably 3 to 85% by weight, more preferably 5 to 70% by weight.

With respect to the type of other ethylenically unsaturated monomers, monomers whose homopolymers are water soluble are preferably used when the solubility of a polymer in an aqueous medium is taken into account. It is noted that monomers whose homopolymers are water insoluble may be used in such an amount as not to detract from the solubility of a polymer.

The molecular weight of a polymer varies with the polarity of the polymer, the type of monomers used, etc. Preferably the polymer have a weight average molecular weight of $2\times10^3$ to $1\times10^6$, especially $3\times10^3$ to $5\times10^5$.

Also included in the polymer having recurring units of formula (1) are polyurethanes of formula (3). Formula (3) is reproduced below and described in detail.

$$-[O-(R-O)_n-]_x-[O-R^3-O]_y-[CONH-R^4-NHCO]_z- \quad (3)$$

In formula (3), R is as defined in formula (2).

$R^3$ is a divalent linkage group, preferably an alkylene group having 1 to 20 carbon atoms (inclusive of substituted alkylene), aralkylene group having 7 to 20 carbon atoms (inclusive of substituted aralkylene), or phenylene group having 6 to 20 carbon atoms (inclusive of substituted phenylene). Substituents on the alkylene, aralkylene and phenylene groups represented by $R^3$ are not particularly limited. Preferred substituents include halogen atoms (e.g., fluorine, chlorine and bromine atoms), cyano, alkoxy (e.g., methoxy, ethoxy, and benzyloxy), aryloxy (e.g., phenoxy), nitro, amino, carboxyl, alkyloxycarbonyl (e.g., methoxycarbonyl and propoxycarbonyl), acyl (e.g., acetyl and benzoyl), alkylcarbamoyl (e.g., dimethylcarbamoyl), acylamino (e.g., acetylamino), and sulfonyl.

$R^4$ is a divalent linkage group, preferably an alkylene group having 1 to 20 carbon atoms (inclusive of substituted alkylene), aralkylene group having 7 to 20 carbon atoms (inclusive of substituted aralkylene), or phenylene group having 6 to 20 carbon atoms (inclusive of substituted phenylene). Substituents on the alkylene, aralkylene and phenylene groups represented by $R^4$ are not particularly limited. Preferred substituents include halogen atoms (e.g., fluorine, chlorine and bromine atoms), cyano, alkoxy (e.g., methoxy, ethoxy, and benzyloxy), aryloxy (e.g., phenoxy), nitro, alkyloxycarbonyl (e.g., methoxycarbonyl and propoxycarbonyl), acyl (e.g., acetyl and benzoyl), alkylcarbamoyl (e.g., dimethylcarbamoyl), acylamino (e.g., acetylamino), and sulfonyl.

Letter n representative of an average number of recurring units is 4 to 200, preferably 4 to 80, more preferably 6 to 40. With n<4, the resulting emulsion would become less capable of exerting mono-dispersity. With n>200, only a smaller number of diol is available for reaction with the isocyanate, restraining efficient introduction of oxyalkylene residues into polyurethane.

More particularly, the polyurethane used herein is generally synthesized by reacting a diol compound (e.g., polyethylene glycol) with a diisocyanate compound.

A first example of the diol compound used herein is a diol of the following general formula (8):

$$HO-(R-O)_n-H \quad (8)$$

wherein R and n are as defined above. Examples of the diol of formula (8) are given below wherein n represents a number of recurring units as above.

| | |
|---|---|
| MP-20 | $HO-(CH_2CH(CH_3)O)_n-H$ |
| MP-21 | $HO-(CH_2CH_2CH_2O)_n-H$ |
| MP-22 | $HO-(CH_2CH_2CH_2CH_2O)_n-H$ |
| MP-23 | $HO-(CH_2CH_2CH_2CH_2CH_2CH_2O)_n-H$ |
| MP-24 | $HO-(CH_2CH(C_6H_5)O)_n-H$ |
| MP-25 | $HO-(CH_2CH(OH)CH_2O)_n-H$ |
| MP-26 | $HO-(CH_2C(CH_3)_2O)_n-H$ |
| MP-27 | $HO-(CH(CH_3)-CH(CH_3)-O)_n-H$ |

The diols may be used in polymer form, for example, a copolymer of MP-1 and MP-3.

In addition to the diol of formula (8), another diol of the following general formula (9) is also useful in the polyurethane of the invention.

$$HO-R^3-OH \quad (9)$$

In formula (9), $R^3$ is as defined above.

Examples of the organic diol include ethylene glycol, 1,2-propane diol, 1,3-propane diol, 1,2-butane diol, 1,3-butane diol, 1,4-butane diol, 2,3-butane diol, 2,2-dimethyl-1,3-propane diol, 1,2-pentane diol, 1,4-pentane diol, 1,5-pentane diol, 2,4-pentane diol, 3,3-dimethyl-1,2-butane diol, 2-ethyl-2-methyl-1,3-propane diol, 1,2-hexane diol, 1,5-hexane diol, 1,6-hexane diol, 2,5-hexane diol, 2-methyl-2,4-pentane diol, 2,2-diethyl-1,3-propane diol, 2,4-dimethyl-2,4-pentane diol, 1,7-heptane diol, 2-methyl-2-propyl-1,3-propane diol, 2,5-dimethyl-2,5-hexane diol, 2-ethyl-1,3-hexane diol, 1,2-octane diol, 1,8-octane diol, 2,2,4-trimethyl-1,3-pentane diol, 1,4-cyclohexane dimethanol, hydroquinone, diethylene glycol, triethylene glycol, dipropylene glycol, and tripropylene glycol.

Since the polyurethane according to the invention is used in the preparation of an emulsion in an aqueous medium, it is preferred to introduce a dissociatable group into the polymer to increase the solubility of the polymer in an aqueous medium. Preferred dissociatable groups are anionic groups such as carboxyl, sulfonic acid, sulfuric monoester, —$OPO(OH)_2$, sulfinic acid, and salts thereof (for example, alkali metal salts such as Na and K, and ammonium salts such as trimethylamine), and cationic groups such as quaternary ammonium salts. Anionic groups are preferred, with the carboxyl group and salts thereof being especially preferred.

Illustrative, non-limiting, examples of the diol having a carboxyl group include 2,2-bis(hydroxymethyl)propionic acid, 2,2-bis(hydroxymethyl)butanoic acid, 2,5,6-trimethoxy- 3,4-dihydroxyhexanoic acid, and 2,3-dihydroxy-4,5-dimethoxy-pentanoic acid.

The diisocyanate constituting the polyurethane compound according to the invention may be of the following general formula (10):

$$O{=}C{=}N{-}R^4{-}N{=}C{=}O \qquad (10)$$

wherein $R^4$ is as defined above.

Preferred examples of the diisocyanate include methylene diisocyanate, ethylene diisocyanate, isophorone diisocyanate, hexamethylene diisocyanate, 1,4-cyclohexyl diisocyanate, 2,4-toluene diisocyanate, 2,6-toluene diisocyanate, 1,3-xylylene diisocyanate, 1,4-xylylene diisocyanate, 1,5-naphthalene diisocyanate, m-phenylene diisocyanate, p-phenylene diisocyanate, 3,3-dimethyl-4,4'-diphenylmethane diisocyanate, 3,3'-dimethylbiphenylene diisocyanate, 4,4'-biphenylene diisocyanate, dicyclohexylmethane diisocyanate, and methylene bis(4-cyclohexylisocyanate).

The diols of formulae (8) and (9) and the diisocyanates of formula (10) may be respectively used alone or in admixture of two or more.

Like the vinyl polymers, the polyurethanes used in the practice of the invention are also desired to be soluble in a medium in which silver halide emulsion grains are formed and hence, soluble in an aqueous medium. The measure of solubility is the same as previously described.

In the polyurethane of formula (3) according to the invention, letters x, y and z represent weight percents of the respective components, x is 1 to 70% by weight, preferably 3 to 50% by weight, more preferably 5 to 40% by weight, y is 1 to 70% by weight, preferably 2 to 60% by weight, more preferably 3 to 50% by weight although y also depends on x, and z is 20 to 70% by weight, preferably 25 to 65% by weight, more preferably 30 to 60% by weight.

When the solubility of a polymer in an aqueous medium is taken into account, a diol having an anionic group (especially carboxyl) falling in the scope of the diol of formula (9) is preferably copolymerized in a polymer in an amount of about 1 to 30% by weight, especially 2 to 25% by weight.

The molecular weight of a polyurethane varies with the polarity of the polymer, the type of monomers used, etc. Preferably the polyurethane have a weight average molecular weight of $2\times10^3$ to $1\times10^6$, especially $3\times10^3$ to $2\times10^5$.

Illustrative, non-limiting examples of the polymer containing recurring units of formula (1) are given below. For vinyl polymers (PP-1 to PP-13, P-1 to P-31), numerals in parentheses represent weight percents of monomers in a polymer. For polyurethanes (PP-14 to PP-18), first and second numerals in parentheses represent weight and molar percents of monomers in a polymer, respectively. PPG is an abbreviation of polypropylene oxide. Mw is an average molecular weight.

List Of Exemplary Polymers

PP-1: MP-3/acrylamide copolymer (10/90)
PP-2: MP-3/acrylamide copolymer (25/75)
PP-3: MP-3/acrylamide copolymer (50/50)
PP-4: MP-3/acrylic acid/acrylamide copolymer (50/30/20)
PP-5: MP-3/acrylic acid copolymer (70/30)
PP-6: MP-2/methacrylamide copolymer (30/70)
PP-7: MP-4/acrylamide copolymer (20/80)
PP-8: MP-7/acrylamide copolymer (30/70)
PP-9: MP-5/acrylamide/methacrylic acid copolymer (25/50/25)
PP-10: MP-12/N,N-dimethylacrylamide/acrylic acid copolymer (30/35/35)
PP-11: MP-7/diacetone acrylamide copolymer (30/70)
PP-12: MP-13/acrylamide/sodium 2-acrylamide-2-methylpropane-sulfonate copolymer (30/60/10)
PP-13: MP-3/MP-18/acrylamide/acrylic acid copolymer (20/20/40/20)
PP-14: isophorone diisocyanate/sodium 2,2-bis(hydroxymethyl)propionate/PPG (Mw=400)/PPG (Mw=1000) (43.1/21.5/15.7/19.7; 50/35/10/5)
PP-15: toluene diisocyanate/sodium 2,2-bis(hydroxymethyl)-butanoate/PPG (Mw=1000) (29.3/20.1/50.6; 50/35/15)
PP-16: 1,5-naphthylene diisocyanate/potassium 2,2-bis-(hydroxymethyl)propionate/PPG (Mw=400) (47.2/24.8/18.0; 50/40/10)
PP-17: 4,4'-diphenylmethane diisocyanate/hexamethylene diisocyanate/sodium 2,2-bis(hydroxymethyl)propionate/PPG (Mw=700) (40.1/6.7/25.0/28.1; 40/10/40/10)
PP-18: 1,5-naphthylene diisocyanate/hexamethylene diisocyanate/sodium 2,2-bis(hydroxymethyl)butanoate/PPG (Mw=400)/polybutylene oxide (Mw=500) (36.2/12.4/29.3/9.8/12.3; 35/15/40/5/5)
P-1: MP-3/ME-4/acrylamide copolymer (5/5/90)
P-2: MP-3/ME-4/acrylamide copolymer (10/10/80)
P-3: MP-3/ME-4/acrylamide copolymer (25/25/50)
P-4: MP-3/ME-4/acrylamide copolymer (35/35/30)
P-5: MP-3/ME-4 copolymer (50/50)
P-6: MP-2/ME-3/acrylamide copolymer (25/15/60)
P-7: MP-5/ME-7/acrylamide/acrylic acid copolymer (20/20/50/10)
P-8: MP-1/MP-4/ME-4/acrylamide copolymer (15/10/25/50)
P-9: MP-5/ME-5/methacrylamide/acrylic acid copolymer (25/25/30/20)
P-10: MP-4/ME-9/acryloylmorpholine/methacrylic acid copolymer (20/10/50/20)
P-11: MP-16/ME-4/acrylamide/sodium 2-acrylamido-2-methylpropanesulfonate copolymer (25/15/45/15)
P-12: MP-9/ME-15/2-hydroxyethyl methacrylate/sodium styrenesulfonate copolymer (10/10/40/40)
P-13: MP-3/ME-2/ME-4/acrylamide copolymer (25/15/15/45)
P-14: MP-3/ME-13/acrylamide copolymer (25/25/50)
P-15: MP-8/ME-9/methyl methacrylate/acrylamide copolymer (20/20/10/50)
P-16: MP-3/acrylamide copolymer (10/90)
P-17: MP-3/acrylamide copolymer (20/80)
P-18: MP-3/acrylamide copolymer (50/50)
P-19: MP-3/acrylic acid/acrylamide copolymer (50/30/20)
P-20: MP-3/acrylic acid copolymer (70/30)

P-21: MP-2/methacrylamide copolymer (30/70)
P-22: MP-4/acrylamide copolymer (20/80)
P-23: MP-7/acrylamide copolymer (40/60)
P-24: MP-5/acrylamide/methacrylic acid copolymer (25/50/25)
P-25: MP-12/N,N-dimethylacrylamide/acrylic acid copolymer (30/35/35)
P-26: MP-7/diacetone acrylamide copolymer (30/70)
P-27: MP-13/acrylamide/sodium 2-acrylamido-2-methylpropane-sulfonate copolymer (30/60/10)
P-28: MP-3/MP-18/acrylamide/acrylic acid copolymer (20/20/40/20)
P-29: MP-3/ME-4/acrylamide copolymer (15/15/70)
P-30: MP-19/ME-17/acrylamide copolymer (15/15/70)
P-31: MP-3/ME-18/acrylamide copolymer (15/15/70)

Of the polymers used herein, the preparation of vinyl polymers and polyurethanes is described below.

The preparation of vinyl polymers may be carried out by various polymerization techniques, for example, solution polymerization, precipitation polymerization, suspension polymerization, bulk polymerization and emulsion polymerization. Polymerization may be initiated by using radical initiators or irradiating light or radiation while thermal polymerization is also employable. Among these polymerization techniques, the initiation of polymerization is described in the literature, for example, Tsuruta, "Polymer Synthesis Reaction," Nikkan Kogyo Shinbun, 1971, and Ohtsu and Kinosita, "Experimental Polymer Synthesis," Kagaku Dojin, 1972, pp. 124–154.

Preferred among these polymerization techniques is solution polymerization using radical initiators. The solvents used in solution polymerization are water and various organic solvents such as ethyl acetate, methanol, ethanol, 1-propanol, 2-propanol, acetone, dioxane, N,N-dimethylformamide, N,N-dimethylacetamide, toluene, n-hexane, and acetonitrile, alone or in admixture of two or more. A solvent mixture of water and an organic solvent may also be used. For the polymer according to the invention, water or a mixture of water and a water-miscible organic solvent is especially preferred.

The polymerization temperature must be determined in conjunction with the molecular weight of a resultant polymer, the type of initiator, etc. and may range from below 0° C. to above 100° C., although polymerization is usually carried out at a temperature of 30 to 100° C.

Examples of the radical initiator used to trigger polymerization include azo initiators such as 2,2'-azobisisobutyronitrile, 2,2'-azobis(2,4-dimethylvaleronitrile), 2,2'-azobis(2-amidinopropane) dihydrochloride, and 4,4'-azobis(4-cyanopentanoic acid), and peroxide initiators such as benzoyl peroxide, t-butyl hydroperoxide and potassium persulfate (which may be used as a redox initiator in combination with sodium hydrogen sulfite).

The amount of the polymerization initiator used may be adjusted in accordance with the polymerizability of monomers and the molecular weight of a polymer although it is preferably 0.01 to 10 mol %, more preferably 0.01 to 2.0 mol % based on the monomers used.

The polymer according to the invention can be synthesized in copolymeric form by initially charging a reactor with the entire amounts of monomers and admitting the initiator therein although it is preferred to synthesize a polymer after monomers are added dropwise to a polymerization medium. When two or more ethylenically unsaturated monomers are used, such monomers may be added dropwise individually or as a mixture. For dropwise addition, the ethylenically unsaturated monomers may be dissolved in a suitable co-solvent. The co-solvent may be water, an organic solvent (as exemplified above) or a mixture of water and an organic solvent. The time taken for dropwise addition varies with the polymerizability of ethylenically unsaturated monomers and polymerization temperature although it is preferably 5 minutes to 8 hours, more preferably 30 minutes to 4 hours. The addition rate may be constant throughout dropwise addition or be suitably changed within the addition time. When ethylenically unsaturated monomers are separately added dropwise, the overall addition time and addition rate of respective monomers may be freely changed as desired. Particularly when ethylenically unsaturated monomers are substantially different in polymerizability, it is preferred that a more reactive monomer be added dropwise more slowly.

The polymerization initiator may be added to a polymerization medium in advance or concurrently with ethylenically unsaturated monomers. Alternatively, a solution of the polymerization initiator in a solvent may be added dropwise separately from the ethylenically unsaturated monomers. Two or more of these addition techniques may be combined.

The preparation of polyurethanes may be carried out by any desired technique although it is preferred to react a diisocyanate with a diol containing a recurring unit of formula (1) or a mixture of that diol and another diol.

Such synthetic reaction is preferably carried out at a temperature of 30 to 150° C., especially 50 to 80° C. A catalyst such as tertiary amines (e.g., tetramethylethylenediamine and 4-dimethylaminopyridine) and organic tin compounds (e.g., dibutyltin laurate and dioctyltin laurate) may be added to promote the reaction between an isocyanate group and a hydroxyl group.

During reaction, a suitable organic solvent may be used for the purpose of preventing the reaction product from solidifying or increasing viscosity. The solvent used herein is preferably one which is inert to an isocyanate group and in which the reaction product is soluble. Preferred examples of the solvent include ketones such as acetone and methyl ethyl ketone, ethers such as tetrahydrofuran, ethylene glycol dimethyl ether, diethylene glycol dimethyl ether, and dioxane, halogenated alkyls such as chloroform and dichloroethane, aromatic hydrocarbons such as benzene, toluene and chlorobenzene, and amides such as N,N-dimethylformamide and N,N-dimethylacetamide. The solvent may be removed by a conventional technique if desired.

With respect to the synthesis of polyurethanes, reference should be made to Iwakura, Masuhara, Suzuki, and Okada, "Experiments of Polymer Chemistry," Asakura Shoten, 1965, pp. 186–187 and 197–204, Gunter Oertel, "Polyurethane Handbook," 1985, p. 21, Murahashi, et al., "Synthetic Polymers-V," pp. 309–359, and Bridgestone K.K. and Nippon Trading K.K. Ed., "Polyurethane," 1960. With respect to the initiator for addition polymerization, concentration, addition polymerization temperature, reaction time, and other parameters, a choice may be made from a wide range and easily altered depending on a particular purpose.

The synthesis of some exemplary polymers within the scope of the invention is described below.

SYNTHESIS EXAMPLE 1

Synthesis Of Compound PP-2

A 1-liter three-necked flask equipped with a stirrer and a reflux condenser was charged with 2.5 g of MP-3, 7.5 g of acrylamide, 0.39 g of sodium hydrogen sulfite, 280 ml of ethanol and 140 g of distilled water and with stirring, heated to 70° C. under a nitrogen stream.

After 20 ml of an aqueous solution containing 0.20 g of potassium persulfate was added, the reaction mixture was heated and stirred for 1 hour. Thereafter, a mixture of 0.60 g of potassium persulfate, 50 ml of ethanol, and 50 ml of distilled water and a mixture of 22.5 g of MP-3, 67.5 g of acrylamide, 100 ml of ethanol, and 100 g of distilled water were concurrently added dropwise at an equal rate over 1.5 hours.

At the end of dropwise addition, 20 ml of an aqueous solution containing 0.20 g of potassium persulfate was added to the reaction mixture, which was heated and stirred for a further 3 hours at 70° C. There was obtained a polymer solution, from which the ethanol was distilled off in vacuum. The polymer was precipitated again from 7 liters of a solvent mixture of acetone and ethyl acetate (1/1 by volume). The resulting powder was filtered and dried in vacuum, obtaining 87.0 g of the end polymer. It had a weight average molecular weight of 49,700 as measured by gel permeation chromatography (GPC).

SYNTHESIS EXAMPLE 2

Synthesis Of Compound P-2

A 1-liter three-necked flask equipped with a stirrer and a reflux condenser was charged with 1.0 g of MP-3, 1.0 g of ME-4, 8.0 g of acrylamide, 0.39 g of sodium hydrogen sulfite, 280 ml of ethanol and 140 g of distilled water and with stirring, heated to 70° C. under a nitrogen stream.

After 20 ml of an aqueous solution containing 0.20 g of potassium persulfate was added, the reaction mixture was heated and stirred for 1 hour. Thereafter, a mixture of 0.60 g of potassium persulfate, 50 ml of ethanol, and 50 ml of distilled water and a mixture of 9.0 g of MP-3, 9.0 g of ME-4, 72 g of acrylamide, 100 ml of ethanol, and 100 g of distilled water were concurrently added dropwise at an equal rate over 1.5 hours.

At the end of dropwise addition, 20 ml of an aqueous solution containing 0.20 g of potassium persulfate was added to the reaction mixture, which was heated and stirred for a further 3 hours at 70° C. There was obtained a polymer solution, from which the ethanol was distilled off in vacuum. The polymer was precipitated again from 7 liters of a solvent mixture of acetone and ethyl acetate (1/1 by volume). The resulting powder was filtered and dried in vacuum, obtaining 85.5 g of the end polymer. It had a weight average molecular weight of 53,500 as measured by GPC.

Further examples of the polymer having recurring units of formula (1) according to the invention are block polymers of polyalkylene oxide represented by the general formulae (4) and (5).

The block polymers of polyalkylene oxide are now described. The polyalkylene oxide compounds which are especially useful in the practice of the invention are polymers having a block polymer component of a hydrophobic polyalkylene oxide of formula (4) and a block polymer component of a hydrophilic polyalkylene oxide of formula (5) in a molecule. The general formulae (4) and (5) are reproduced below.

(4)

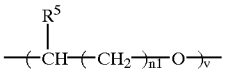

-continued (5)

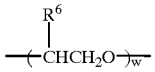

In the formulae, $R^5$ is hydrogen, an alkyl having 1 to 10 carbon atoms (e.g., methyl, chloromethyl, ethyl and n-butyl), or an aryl group having 6 to 10 carbon atoms (e.g., phenyl and naphthyl), and n1 is an integer of 1 to 10. Note that $R^5$ is not hydrogen where n1=1.

$R^6$ is hydrogen or a lower alkyl group of up to 4 carbon atoms having a hydrophilic substituent (e.g., hydroxyl and carboxyl) such as hydroxymethyl and carboxymethyl.

Letters w and v represent the number of recurring units associated therewith (corresponding to a number average degree of polymerization). Although the preferred range of w and v varies with the structure of a polymer, w is usually 2 to 200, preferably 2 to 50 and v is usually 2 to 200, preferably 2 to 50.

The ratio of the component of formula (4) to the component of formula (5) in the block polymer may vary with the hydrophilic and hydrophobic properties of emulsion layer units and the type of an emulsion to be prepared therefrom Broadly stated, the weight ratio of the component of formula (4) to the component of formula (5) ranges from 4:96 to 96:4.

Preferred among the hydrophobic polyalkylene oxides of formula (4) is polypropylene oxide wherein $R^5$=methyl and n1=1. Preferred among the hydrophilic polyalkylene oxides of formula (5) are polyethylene oxide wherein $R^6$=hydrogen and polyglycerol wherein $R^6$=$CH_2OH$, especially polyethylene oxide.

Of the polymers having the above-mentioned block copolymer components in a molecule, compounds having typical block copolymer components of polypropylene oxide and polyethylene oxide are described in further detail.

Typical examples of the block polymer used herein are represented by the following general formulae (11) to (18).

(11)

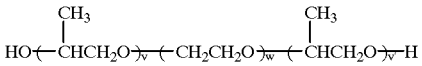

(12)

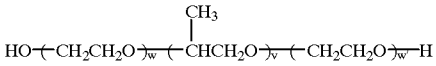

(13)

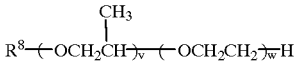

(14)

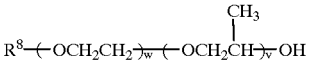

(15)

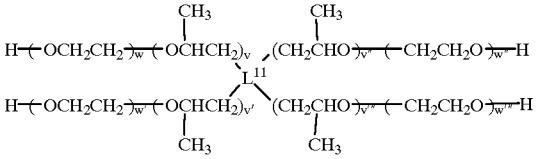

-continued (16)

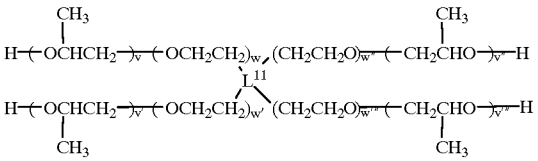

(17)

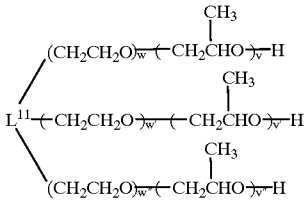

(18)

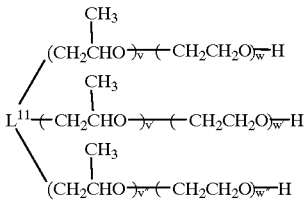

(17)

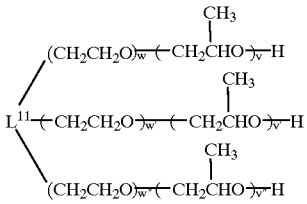

(18)

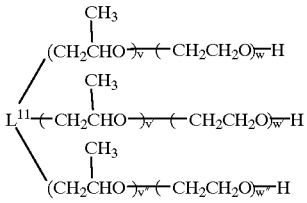

In formulae (11) to (18), w, w', w", w'", v, v', v", and v'" represent the number of recurring units associated therewith and the preferred ranges thereof are the same as those of w and v in formulae (4) and (5). $R^8$ is a monovalent group, for example, hydrogen, a substituted or unsubstituted alkyl group or aryl group, preferably a substituted or unsubstituted lower alkyl group having up to 6 carbon atoms. The group represented by $R^8$ is exemplified by methyl, ethyl, n-propyl, isopropyl, t-butyl, chloromethyl, methoxycarbonylmethyl, N-methyl-N-ethylaminoethyl, and N,N-diethylaminoethyl.

$L^{11}$ is a trivalent or tetravalent linkage group. Illustrative, non-limiting examples of the group represented by $L^{11}$ are given below.

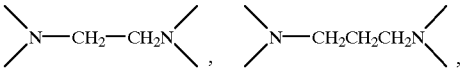

-continued

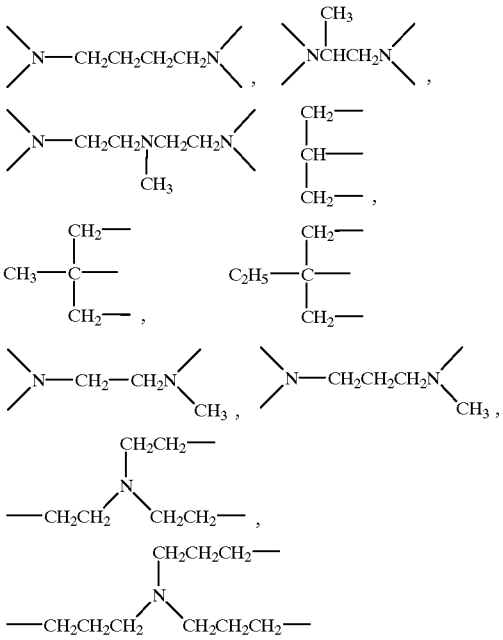

Illustrative, non-limiting examples of the polymer having block polymer components in a molecule are given in Tables 1 and 2.

TABLE 1

| Compound No. | Polymer type (general formula No.) | $R^8$ | w | v |
|---|---|---|---|---|
| B-1 | (11) | — | 7 | 25 |
| B-2 | (11) | — | 5 | 15 |
| B-3 | (11) | — | 27 | 15 |
| B-4 | (11) | — | 125 | 23 |
| B-5 | (11) | — | 42 | 23 |
| B-6 | (11) | — | 16 | 23 |
| B-7 | (12) | — | 10 | 15 |
| B-8 | (12) | — | 40 | 15 |
| B-9 | (12) | — | 2 | 32 |
| B-10 | (12) | — | 9 | 32 |
| B-11 | (12) | — | 20 | 32 |
| B-12 | (12) | — | 135 | 50 |
| B-13 | (12) | — | 14 | 50 |
| B-14 | (13) | $CH_3$- | 35 | 30 |
| B-15 | (13) | $C_3H_7$- | 25 | 50 |
| B-16 | (13) | $C_2H_5$- | 20 | 70 |
| B-17 | (14) | $CH_3$- | 40 | 25 |
| B-18 | (14) | $(CH_3)_2CH$- | 50 | 30 |

Note that v' in exemplary compounds of formula (4) is equal to v and that w' in exemplary compounds of formula (5) is equal to w.

TABLE 2

| Compound No. | Polymer type (general formula No.) | $L^{11}$ | w | v |
|---|---|---|---|---|
| B-19 | (15) | 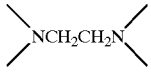 | 2 | 15 |
| B-20 | (15) | | 16 | 17 |
| B-21 | (15) | | 4 | 32 |

TABLE 2-continued

| Compound No. | Polymer type (general formula No.) | $L^{11}$ | w | v |
|---|---|---|---|---|
| B-22 | (15) | | 140 | 32 |
| B-23 | (16) | | 18 | 20 |
| B-24 | (16) | | 4 | 33 |
| B-25 | (16) | | 108 | 20 |
| B-26 | (15) | 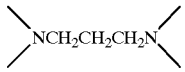 | 15 | 20 |
| B-27 | (17) | 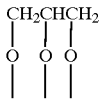 | 10 | 25 |
| B-28 | (17) | | 40 | 20 |
| B-29 | (18) | 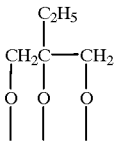 | 15 | 17 |
| B-30 | (18) | | 85 | 33 |
| B-31 | (17) | 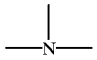 | 16 | 23 |
| B-32 | (18) | | 25 | 20 |
| B-33 | (18) | | 55 | 30 |

Note that w', w", w'" and v', v", v'" in the respective general formulae are equal to w and v, respectively.

With respect to illustrative examples and the general description of the polymers used in the practice of the invention, reference should be made to EP-A 513722, 513723, 513724, 513725, 513742, 513743, and 518066.

Upon growth of nuclei, silver iodobromide or silver chloroiodobromide is grown by the double jet method without adding the polymer having recurring units of formula (1). As previously mentioned, the silver halide is tabular grains having an aspect ratio of at least 5. The silver halide grains used herein preferably have a diameter of at least 0.8 $\mu$m, more preferably 1 to 2 $\mu$m, calculated as a circle equivalent grain size based on the projected area of grains, and a thickness of 0.05 to 0.4 $\mu$m, more preferably 0.1 to 0.3 $\mu$m.

According to the invention, the silver halide grains are subject to chemical sensitization. To this end, sulfur sensitization, selenium sensitization, tellurium sensitization (these three are generally designated chalcogen sensitization), noble metal sensitization and reduction sensitization are used alone or in combination. Among these, selenium sensitization is essential in the practice of the invention while a compound capable of forming a complex with gold such as sodium sulfite as described in Japanese Patent Application No. 167798/1994 may be concurrently used.

For the sulfur sensitization, unstable sulfur compounds are used as described in, for example, P. Grafkides, Chimie et Physique Photographique, 5th Ed., Paul Montel, 1987, and Research Disclosure, Vol. 307, No. 307105. The unstable sulfur compounds used herein are well-known sulfur compounds, for example, thiosulfates (e.g., hypo), thioureas (e.g., diphenylthiourea, triethylthiourea, N-ethyl-N'-(4-methyl-2-thiazolyl)thiourea, and carboxymethyltrimethylthiourea), thioamides (e.g., thioacetamide), rhodanines (e.g., diethylrhodanine and 5-benzylidene-N-ethylrhodanine), phosphine sulfides (e.g., trimethylphosphine sulfide), thiohydantoins, 4-oxo-oxazolidine-2-thiones, di- or poly-sulfides (e.g., dimorpholine disulfide, cystine, and hexathionic acid), mercapto compounds (e.g., cysteine), polythionates, and elemental sulfur as well as active gelatin.

For the selenium sensitization, unstable selenium compounds are used as described in, for example, JP-B 13489/1968, 15748/1969, JP-A 25832/1992, 109240/1992, Japanese Patent Application Nos. 53693/1991 and 82929/1991. More particularly, useful selenium compounds are, for example, colloidal metallic selenium, selenoureas (e.g., N,N-dimethylselenourea and trifluoromethylcarbonyltrimethylselenourea), selenoamides (e.g., selenoacetamide and N,N-diethylphenylselenoacetamide), phosphine selenides (e.g., triphenylphosphine selenide and pentafluorophenyl-triphenylphosphine selenide), selenophosphates (e.g., tri-p-tolylselenophosphate and tri-n-butylselenophosphate), selenoketones (e.g., selenobenzophenone), isoselenocyanates, selenocarboxylic acids and esters, and diacylselenides. Also useful are unstable selenium compounds as described in JP-B 4553/1971 and 34492/1977, for example, selenites, potassium selenocyanide, selenazoles, and selenides.

For the tellurium sensitization, unstable tellurium compounds are used as described in, for example, Canadian Patent No. 800,958, UKP 1,295,462, 1,396,696, Japanese Patent Application Nos. 333819/1990, 53693/1991, 131598/1991 and 129787/1992. Examples of the tellurium compound include telluroureas (e.g., telluromethyltellurourea, N,N'-dimethyl-ethylenetellurourea, and N,N-diphenylethylenetellurourea), phosphine tellurides (e.g., butyl-diisopropylphosphine telluride, tributylphosphine telluride, tributoxyphosphine telluride, and ethoxydiphenylphosphine telluride), diacyl(di)tellurides (e.g., bis(diphenylcarbamoyl)-ditelluride, bis(N-phenyl-N-methylcarbamoyl)ditelluride, bis(N-phenyl-N-methylcarbamoyl)telluride, and bis(ethoxycarbonyl)telluride), isotellurocyanates, telluroamides, tellurohydrazides, telluroesters (e.g., butylhexyltelluro ester), telluroketones (e.g., telluroacetophenone), colloidal tellurium, (di)tellurides, and other tellurium compounds (potassium telluride and sodium telluropentathionate).

For the noble metal sensitization, salts of noble metals such as gold, platinum, palladium, and iridium may be used as described in the above-referred P. Grafkides, Chimie et Physique Photographique, 5th Ed., Paul Montel, 1987, and Research Disclosure, Vol. 307, No. 307105. Gold sensitization is especially preferred. Useful examples are chloroauric acid, potassium chloroaurate, potassium aurithiocyanate, gold sulfide, gold selenide and other gold compounds as described in U.S. Pat. Nos. 2,642,361, 5,049,484, and 5,049,485.

For the reduction sensitization, well-known reducing materials may be used as described in the above-referred P. Grafkides, Chimie et Physique Photographique, 5th Ed., Paul Montel, 1987, and *Research Disclosure, Vol.* 307, No. 307105. Useful examples are aminoiminomethanesulfonic acids (also known as thiourea dioxide), borane compounds (e.g., dimethylaminoborane), hydrazine compounds (e.g., hydrazine and p-tolylhydrazine), polyamine compounds (e.g., diethylenetriamine and triethylenetetramine), stannous chloride, silane compounds, reductones (e.g., ascorbic acid), sulfites, aldehydes, and hydrogen gas. Reduction sensitization may also be performed in an atmosphere of high pH or excess silver ion (known as silver ripening). Disulfide compounds (e.g., sodium ethyl thiosulfonate) are preferably co-present during reduction sensitization because fog is reduced.

These chemical sensitization methods may be used alone or in combination of two or more. If combined, a combination of chalcogen sensitization and gold sensitization is preferred, and a combination of sulfur sensitization, selenium sensitization and gold sensitization is most preferred. The reduction sensitization is preferably performed upon growth of the seed emulsion.

The amount of the chalcogen sensitizer used herein is preferably about $10^{-8}$ to $10^{-2}$ mol, more preferably about $10^{-7}$ to $5\times10^{-3}$ mol per mol of the silver halide although it varies with the silver halide grains used and chemical sensitization conditions.

The amount of the noble metal sensitizer used herein is preferably about $10^{-7}$ to $10^{-2}$ mol per mol of the silver halide. No particular limits are imposed on the conditions of chemical sensitization although preferred conditions include pAg 6 to 11, more preferably pAg 7 to 10, pH 4 to 10, and a temperature of 40 to 95° C., more preferably 45 to 85° C.

The layer containing tabular silver halide grains preferably has a thickness of 0.3 to 5.0 $\mu$m, more preferably 0.5 to 4.0 $\mu$m, most preferably 0.5 to 3.0 $\mu$m.

No particular limits are imposed on other components of the layer containing tabular silver halide grains, for example, binders, hardeners, antifoggants, silver halide stabilizers, etc. Reference should be made to, for example, Research Disclosure, Vol. 176, items 22–28, December 1978.

In the practice of the invention, silver halide grains are prepared by adding preformed fine grains of preferably silver bromide to a reaction solution containing water and gelatin, adding potassium bromide thereto, and adjusting the solution at appropriate pBr. Thereafter, silver and halide solutions are added to the reaction solution in such a manner that new crystal nuclei may not be generated. This technique is described in U.S. Pat. No. 4,879,208 and JP-A 183644/1989, 183645/1989, 44335/1990, 43534/1990 and 43535/1990. The present invention is characterized in that the seed crystals used are pure silver bromide or silver chlorobromide, preferably pure silver bromide and that a polyalkylene oxide of the general formula (1) is preferably used during preparation of the seed crystals.

The size of tabular silver halide grains can be adjusted by controlling the size of seed crystals, the amount of seed crystals admitted, the temperature during growth, the type and amount of solvent, and the addition rates of silver salt and halide used upon grain growth.

For example, the grain size distribution becomes monodisperse and the rate of growth increases as the amount of the solvent used is increased. There is also a tendency that grains increase thickness as the amount of the solvent used is increased. The frequently used silver halide solvents include ammonia, thioethers, and thioureas. With respect to the thioethers, reference should be made to U.S. Pat. Nos. 3,271,157, 3,790,387, and 3,574,628.

The preparation of tabular silver halide grains according to the invention preferably employs methods of increasing the addition rate, addition amount and addition concentration of a silver salt solution to be added (e.g., an aqueous KBr solution) for accelerating grain growth. With respect to these methods, reference should be made to UKP 1,335,925, U.S. Pat. Nos. 3,672,900, 3,650,757, and 4,242,445, JP-A 142329/1980 and 158454/1980.

For simultaneous admixing of an aqueous silver salt solution and an aqueous halide solution, there may be used a technique of maintaining constant the pAg of a liquid phase in which silver halide is created, which is known as a controlled double jet technique. A technique of changing the rate of addition of an aqueous solution of silver nitrate or alkali halide in accordance with a growth rate of grains as described in UKP 1,535,016 and JP-B 36890/1973 and 16364/1977 and a technique of changing the concentration of such aqueous solution as described in U.S. Pat. No. 4,242,445 and JP-A 158124/1980 are also preferably used to allow grains to grow at a quick rate in the range not in excess of the critical supersaturation. These techniques are preferred because silver halide grains grow uniformly without re-nucleation.

In the practice of the invention, emulsion grains of various structures may be used. There may be used grains of the core/shell double structure consisting of the interior or core and the exterior or shell of a grain, grains of the triple structure as disclosed in JP-A 222844/1985, and grains of multiple structure. When a structure is imparted to the interior of emulsion grains, not only grains of the envelope structure as mentioned above, but grains having a so-called junction structure may also be prepared. Examples of these structured grains are disclosed in JP-A 133540/1984, 108526/1983, EP 199,290A2, JP-B 24772/1983 and JP-A 16254/1984.

The present invention is characterized by the halogen composition that the shell always has a higher iodine content than the grain center since grains are preferably grown on nuclei of pure silver bromide.

Crystals to be joined can be grown with a composition different from host crystals and contiguous to edges, corners or faces of host crystals. Such contact crystals can be formed even when the host crystals are uniform in halogen composition or have a structure of the core-shell type.

In the case of the junction structure, a combination of silver halide grains is, of course, possible while a junction structure can be established by combining a silver chloride which does not have the rock salt structure such as silver rhodanide and silver carbonate with a silver halide. A non-silver salt compound such as PbO may also be used if it can form a junction structure.

The silver iodobromide grains according to the invention are grains whose core has a low silver iodide content and whose shell has a high silver iodide content. Where such grains have a junction structure, they may be either grains whose host crystals have a high silver iodide content and whose contact crystals have a low silver iodide content or vice verse. In grains having such a structure, the boundary between different halogen compositions may be either a definite boundary or an indefinite boundary where mixed crystals are formed by a differential composition. Also a continuous structural change may be positively induced.

The silver halide emulsion used herein may be subject to grain rounding treatment as disclosed in EP-0096727B1 and EP-0064412B1 or surface modification as disclosed in DE-230644C2 and JP-A 221320/1985.

The silver halide emulsion used herein is preferably of the surface latent image type although an emulsion of the internal latent image type may also be used if a developer or developing conditions are properly selected as disclosed in JP-A 133542/1984. A latent internal latent image type emulsion having a thin shell wrapped is also useful as the case may be.

In the practice of the invention, silver halide grains having a transition line are preferably used. The grains having a transition line are disclosed in U.S. Pat. No. 4,806,461.

In the step of forming or physically ripening silver halide grains, there may be co-present cadmium salts, zinc salts, lead salts, thallium salts, iridium salts or complex salts thereof, iron salts or complex salts thereof.

As a general rule, the emulsion of the present invention is spectrally sensitized. The dyes useful for spectral sensitization include cyanine dyes, merocyanine dyes, complex cyanine dyes, and complex merocyanine dyes. Preferred among them are cyanine dyes of the monomethine type, especially cyanine dyes of the monomethine type further having a thiazole or oxazole nucleus, alone or in admixture of two or more. Cyanine dyes of the monomethine type for use with tabular grains are disclosed in JP-A 55426/1984.

To these dyes, any nuclei generally utilized for cyanine dyes can be applied as basic heterocyclic ring nuclei. For example, applicable are pyrroline nuclei, oxazoline nuclei, selenazoline nuclei, pyrrole nuclei, oxazole nuclei, thiazole nuclei, selenazole nuclei, imidazole nuclei, tellurazole nuclei, pyrimidine nuclei, tetrazole nuclei, etc.; and nuclei in the form of the foregoing nuclei having a cycloaliphatic hydrocarbon ring fused thereto and nuclei of the foregoing nuclei having an aromatic hydrocarbon ring fused thereto, such as indolenine nuclei, benzindolenine nuclei, indole nuclei, benzoxazole nuclei, naphthoxazole nuclei, benzimidazole nuclei, naphthoimidazole nuclei, benzothiazole nuclei, naphthothiazole nuclei, benzoselenazole nuclei, naphthoselenazole nuclei, quinoline nuclei, benzotetrazole nuclei, etc. These nuclei may be substituted on a carbon atom(s).

For the merocyanine and complex merocyanine dyes, those nuclei generally used for merocyanine dyes are applicable as a nucleus having a ketomethylene structure, for example, 5- or 6-membered heterocyclic nuclei such as a pyrazolin-5-one nucleus, thiohydantoin nucleus, 2-thiooxazolidine-2,4-dione nucleus, rhodanine nucleus, thiobarbituric acid nucleus, and 2-thioselenazolidine-2,4-dione nucleus.

These sensitizing dyes may be used alone or in combination. Combinations of sensitizing dyes are often used particularly for the purpose of supersensitization. Typical examples are found in the following patents.

| | | |
|---|---|---|
| USP 2,688,545 | 2,977,229 | 3,397,060 |
| 3,522,052 | 3,527,641 | 3,617,293 |
| 3,628,964 | 3,666,480 | 3,672,898 |
| 3,679,428 | 3,703,377 | 3,769,301 |
| 3,614,609 | 3,837,862 | 4,026,707 |
| UKP 1,344,281 | 1,507,803 | |
| JP-B 4936/1968 | 12375/1978 | |
| JP-A 110618/1977 | 109925/1977 | |

Preferably, the emulsion of the present invention is spectrally sensitized with sensitizing dyes of the general formula (I). The dyes used to this end belong to monomethine cyanine dyes.

(I)

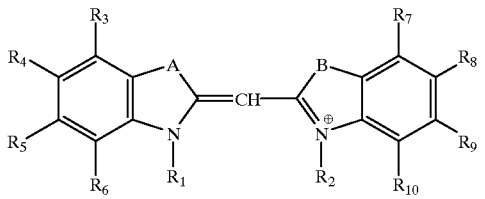

In formula (I), each of A and B is a sulfur atom, oxygen atom or imino group (which may have an alkyl group as a substituent), with the sulfur or oxygen atom being preferred, the sulfur atom being especially preferred.

Each of $R_1$ and $R_2$ is a sulfoalkyl group. As a general rule, the terminal sulfonic group on the $R^1$ side is dissociated into a sulfonic anion and the terminal sulfonic group on the $R^2$ side forms an ion pair with a counter ion. The counter ion species may include alkali metal, trialkyl ammonium, and tetraalkyl ammonium cations. The trialkyl ammonium cations are preferred, with triethyl ammonium being most preferred. With respect to the alkyl chain length, linear or branched alkyl groups of 2 to 10 methylene chains are preferred, with linear alkyl groups of 2 to 4 methylene chains being most preferred.

Each of $R_3$ to $R_{10}$ is a hydrogen atom, halogen atom, alkyl group, alkenyl group, alkoxy group, aryl group or heterocyclic group. Adjacent groups may form a ring, for example, a benzene ring. The alkyl, alkenyl, alkoxy, aryl or heterocyclic groups may further have a substituent(s), for example, halogen atom, alkyl, alkenyl, alkoxy, and aryl groups. Preferred examples of the group represented by $R_3$ to $R_{10}$ include hydrogen, chlorine, fluorine, bromine, methyl, ethyl, i-propyl, benzyl, allyl, vinyl, methoxy, ethoxy, phenyl, morpholino, and benzotriazole, with the hydrogen, 1S chlorine, phenyl and methoxy being especially preferred. Most preferably, one of $R_3$ to $R_6$ is a substituent such as chlorine, phenyl and methoxy and/or one of $R_7$ to $R_{10}$ is a substituent such as chlorine, phenyl and methoxy.

Illustrative, non-limiting examples of the sensitizing dye are given below.

D-1

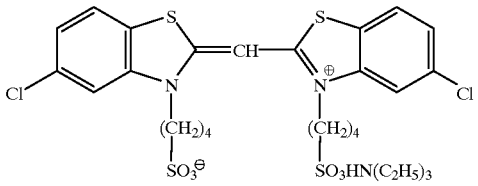

D-1

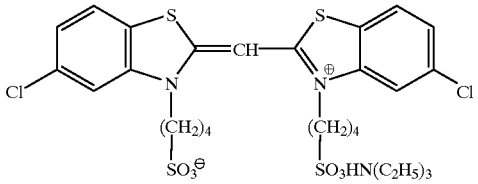

D-2

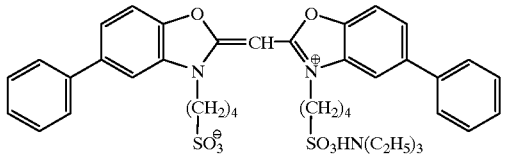

D-3

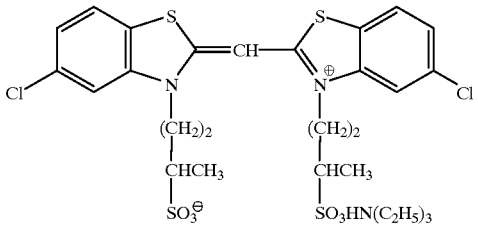

D-4

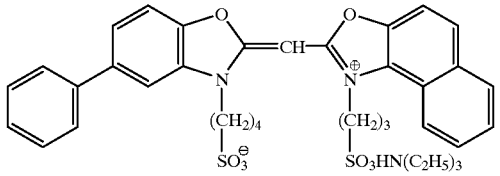

-continued

D-5

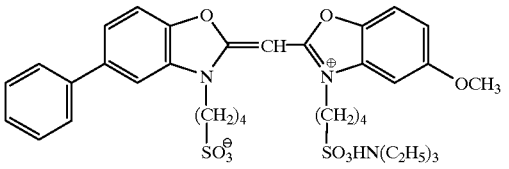

D-6

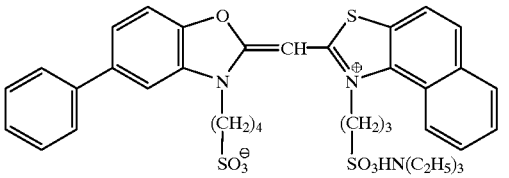

D-7

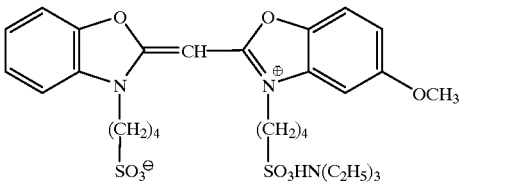

D-8

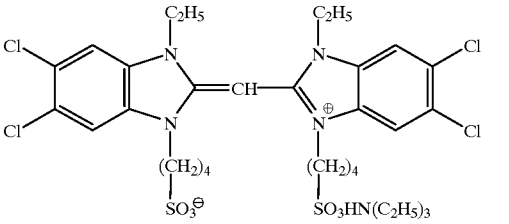

The preferred amount of the sensitizing dye added is 150 to 450 mg per mol of silver, more preferably 200 to 400 mg per mol of silver.

These sensitizing dyes may be used in combination with any of dyes which themselves do not have spectral sensitization function and compounds which do not substantially absorb visible light, but enhance spectral sensitization when combined with the sensitizing dye, which are known as supersensitizers. Typical examples of the supersensitizer include bispyridinium salts as described in JP-A 142541/1984, stilbene derivatives as described in JP-B 18691/1984, water-soluble bromides and water-soluble iodides such as potassium bromide and potassium iodide as described in JP-B 46932/1974, condensation products of aromatic compounds and formaldehyde as described in U.S. Pat. No. 3,743,510, cadmium salts, and azaindenes, especially 4-hydroxy substituted 1,3,3a,7-tetraazaindenes. They are preferably added prior to the addition of the sensitizing dye.

The sensitizing dye may be added to the emulsion either before or after chemical ripening. Preferably, the sensitizing dye is added during or before chemical ripening, for example, during grain formation, during physical ripening, and at the end of desalting.

Additionally, the photographic emulsion used herein may contain various additives for the purposes of preventing fog during preparation, shelf storage and photographic processing of the photosensitive material and stabilizing photographic performance. Useful additives include a number of compounds generally known as antifoggants and stabilizers, for example, azoles (e.g., benzothiazolinium salts), nitroindazoles, triazoles, benzotriazoles, benzimidazoles, mercaptothiadiazoles, mercaptotetrazoles (e.g., 1-phenylmercaptotetrazole), mercaptopyrimidines; heterocyclic mercapto compounds having a water-soluble group such as carboxyl and sulfone groups; thioketo compounds, for example, oxazolinethion; azaindenes, for example, tetraazaindenes, especially 4-hydroxy substituted 1,3,3a,7-tetraazaindenes; benzenethiosulfonates; and benzenesulfinic acid.

In the emulsion layer according to the invention, a thiocyanate may be contained in an amount of $1.0\times10^{-3}$ to $3.0\times10^{-2}$ mol per mol of silver. The thiocyanate may be added at any step including grain formation, physical ripening, grain growth, chemical sensitization, and coating steps, preferably prior to chemical sensitization. The thiocyanates which are used during preparation of the silver halide emulsion according to the invention are water-soluble salts of thiocyanic acid such as metal salts and ammonium salts. In the case of metal salts, the metal which does not adversely affect photographic performance must be selected. Potassium and sodium salts are preferred in this sense. Difficultly soluble salts such as AgSCN may be added in microparticulate form.

These antifoggants or stabilizers are usually added after chemical sensitization, preferably during chemical ripening or before the start of chemical ripening.

The silver halide emulsion prepared by the above-mentioned procedure according to the invention may also be used in picture-taking photosensitive materials such as color negative film and color reversal film.

In addition to the above-mentioned emulsion layer, the photographic photosensitive material of the invention has at least one non-photosensitive hydrophilic colloid layer, preferably at least two non-photosensitive hydrophilic colloid layers. The non-photosensitive hydrophilic colloid layers include a surface protective layer, antihalation layer, undercoat layer, mordant layer and the like.

According to the invention, the non-photosensitive hydrophilic colloid layer coated under the photosensitive silver halide emulsion layer preferably contains a solid particle dispersion of a dyestuff, which is described below in detail.

The dyestuffs include well-known dyestuffs and pigments, for example, those described in Yuki Gosei Kagaku Kyokai Ed., "Dyestuff Handbook," 1970, pp. 315–1109, and Sikizai Kyokai Ed., "Coloring Matter Engineering Handbook," 1989, pp. 225–417. Preferred are dyestuffs of the following general formula (FA).

$$D—(X)_{y1} \qquad \text{(FA)}$$

In formula (FA), D is a group (inclusive of ion) derived from a compound having a chromophore. X is dissociatable proton directly bonding to D, a group having such dissociatable proton, dissociatable proton having attached thereto a divalent linkage group bonding to D or a group having such dissociatable proton. Letter y1 is an integer of 1 to 7.

The compound having a chromophore from which the group represented by D is derived may be selected from many well-known dye compounds. Exemplary are oxonol, merocyanine, cyanine, arylidene, azomethine, triphenylmethane, azo, anthraquinone, and indoaniline dyes.

X is dissociatable proton or a group having such dissociatable proton. The dissociatable proton or the dissociatable proton in the group having dissociatable proton, represented by X or contained in X, is non-dissociatable in the state where the compound of formula (FA) is added to the silver halide photographic material of the invention, and has a property to render the compound of formula (FA) substantially water insoluble. Examples of the group in which the dissociatable proton participates include a carboxylic group, sulfonamide group, arylsulfamoyl group, sulfonylcarbamoyl group, carbonylsulfamoyl group, enol group of an oxonol dye, and phenolic hydroxyl group. These groups are constructed by part of D and X or part of X, or by X or part of X. Preferred among these groups are carboxylic and sulfonamide groups, with the carboxylic group being most preferred.

Letter y1 is preferably an integer of 1 to 4.

Preferred among the dyestuffs of formula (FA) are dyestuffs of the following formulae (FA1), (FA2) and (FA3).

$$A_1{=}L_1{-}(L_2{=}L_3)_{p1}{-}Q \quad \text{(FA1)}$$

$$A_1{=}L_1{-}(L_2{=}L_3)_{p2}{-}A2 \quad \text{(FA2)}$$

$$A_1{=}L_1{-}(L_2{=}L_3)_{p3}{-}B1 \quad \text{(FA3)}$$

In the formulae, each of $A_1$ and $A_2$ is an acidic nucleus, $B_1$ is a basic nucleus, Q is an aryl or heterocyclic group, each of $L_1$, $L_2$ and $L_3$ is a methine group, letter p1 is equal to 0, 1 or 2, each of letters p2 and p3 is equal to 0, 1, 2 or 3. The compounds of formulae (FA1) to (FA3) have in a molecule at least one group selected from the class consisting of a carboxylic group, sulfonamide group, arylsulfamoyl group, sulfonylcarbamoyl group, carbonylsulfamoyl group, enol group of an oxanol dye, and phenolic hydroxyl group, but are free of any water-soluble group (e.g., sulfonic and phosphoric groups) other than that.

The acidic nucleus represented by $A_1$ and $A_2$ is a nucleus possessing dissociatable proton or a group having such dissociatable proton. The basic nucleus represented by B1 includes such basic nuclei as amino and substituted amino groups (inclusive of cyclized ones) and can be a cationic nucleus.

More illustratively, the acidic nucleus represented by $A_1$ and $A_2$ is preferably a cyclic ketomethylene compound or a compound having electron attractive groups separated by a methylene group. Examples of the cyclic ketomethylene compound include 2-pyrazon-5-one, rhodanine, hydantoin, thiohydantoin, 2,4-oxazolidione, isooxazolone, barbituric acid, thiobarbituric acid, indane dion, dioxopyrazolopyridine, hydroxypyridone, pyrazolidine dion, 2,5-dihydrofuran-2-one.

Examples of the basic nucleus represented by $B_1$ include pyridine, quinoline, indolenine, oxazole, imidazole, thiazole, benzoxazole, benzimidazole, benzothiazole, oxazoline, naphthooxazole, and pyrrole.

Exemplary arenes in the aryl group represented by Q are benzene and naphthalene. Exemplary heterocycles in the heterocyclic group represented by Q are furan, pyrrole, indole, thiophene, imidazole, pyrazole, indolidine, quinoline, carbazole, and phenothiazine. These groups may have a substituent such as amino and alkoxy groups.

The methine groups represented by $L_1$ to $L_3$ may have a substituent or adjacent ones may, taken together, form a 5- or 6-membered ring (e.g., cyclopentene and cyclohexene).

Preferably, letter p1 is equal to 0 or 1, p2 is equal to 0, 1 or 2, and p3 is equal to 2 or 3.

Illustrative, non-limiting examples of the dyestuff of formula (FA) are given below.

(F-1)

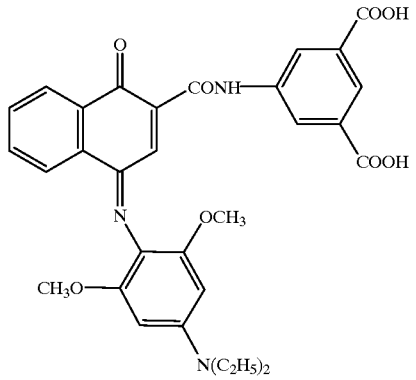

(F-2)

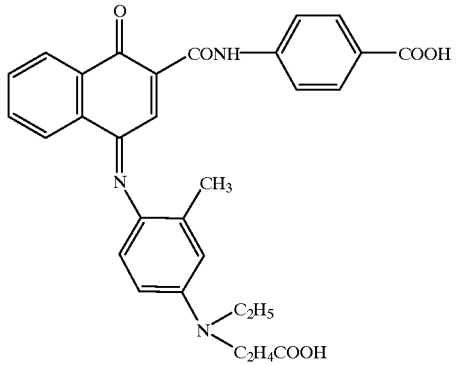

-continued
(F-3)
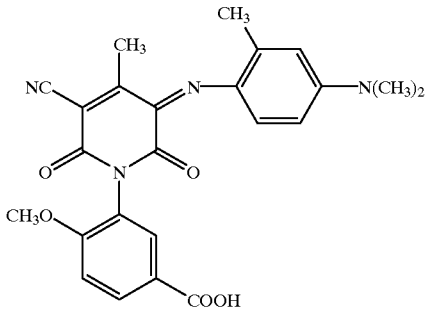
(F-4)
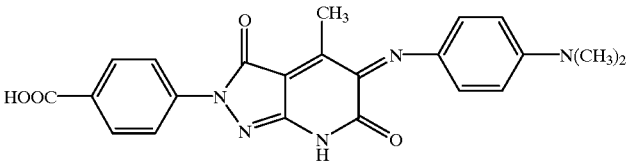
(F-5)
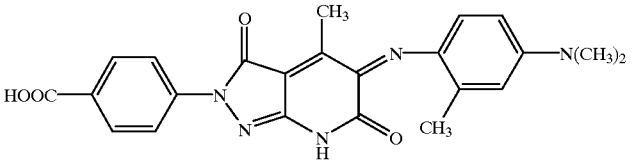
(F-6)
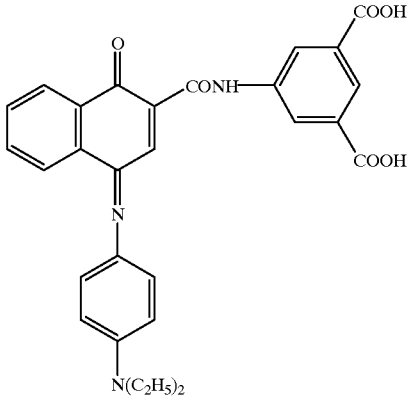
(F-7)
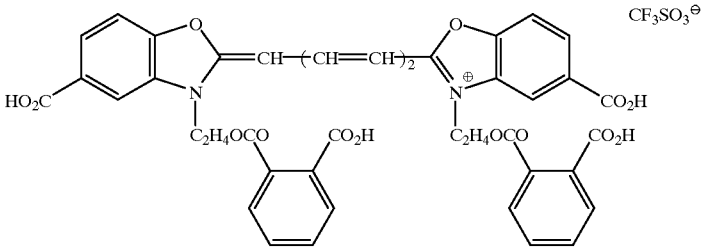

-continued
(F-8)
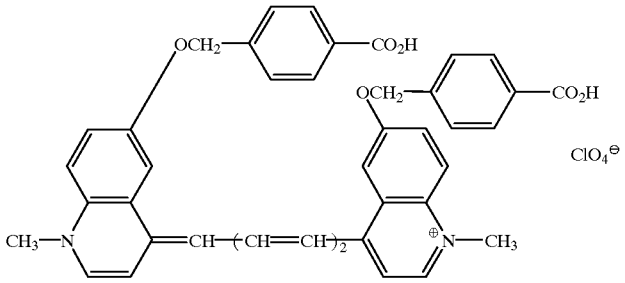
(F-9)
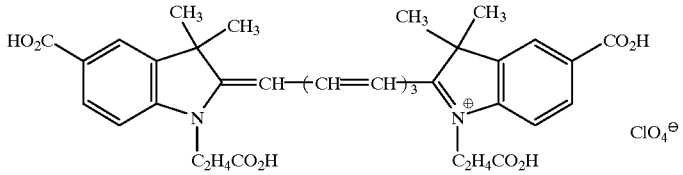
(F-10)
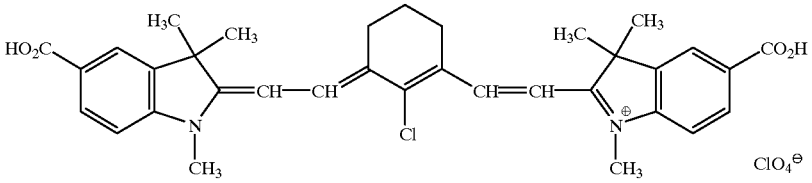
(F-11
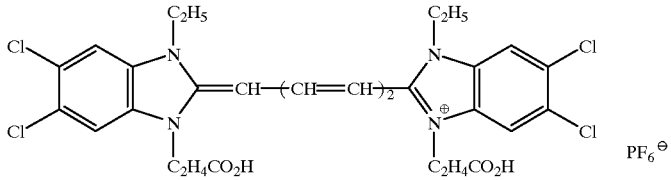
(F-12)
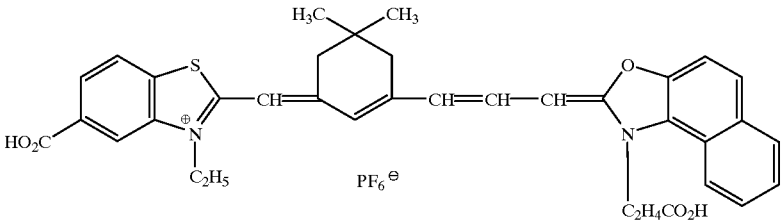
(F-13)
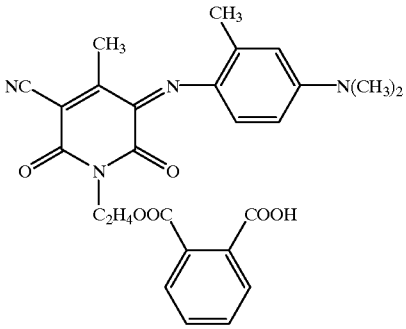

-continued
(F-14)
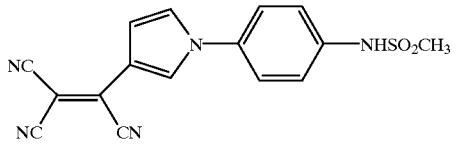
(F-15)
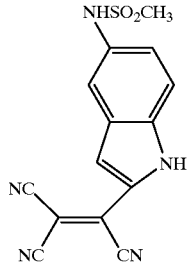
(F-16)
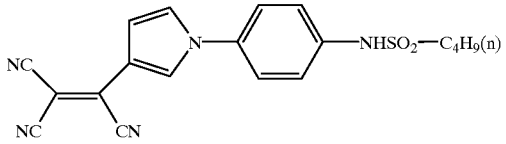
(F-17)
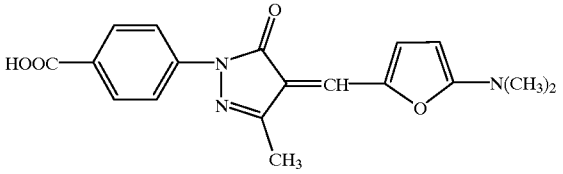
(F-18)
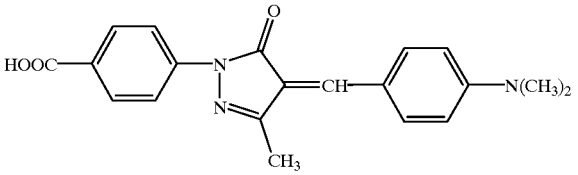
(F-19)
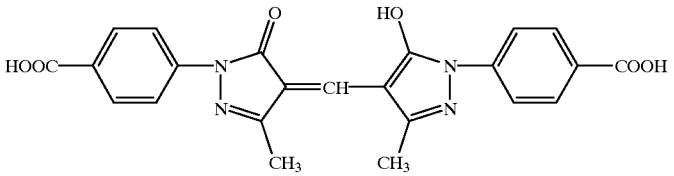
(F-20)
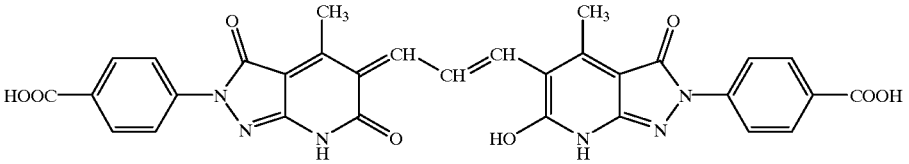

-continued
(F-21)
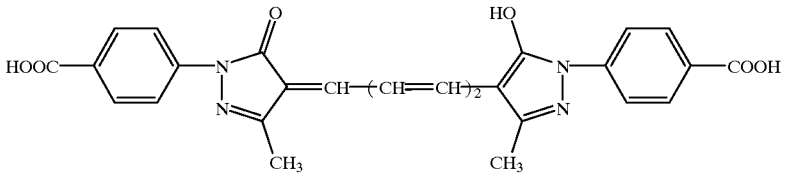
(F-22)
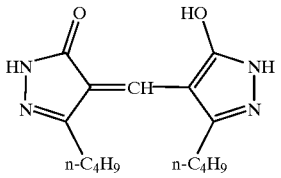
(F-23)
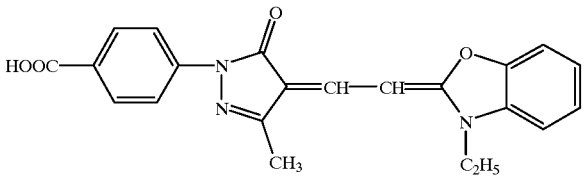
(F-24)
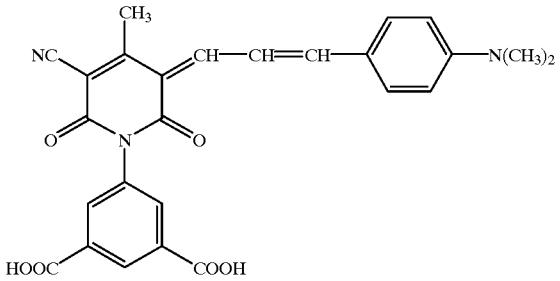
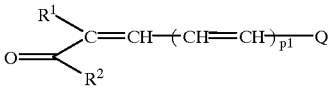
| No. | $R^1$ | $R^2$ | $P_1$ | Q |
|---|---|---|---|---|
| F-25 | —CN | 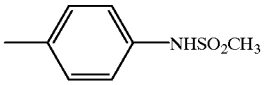 | 0 | 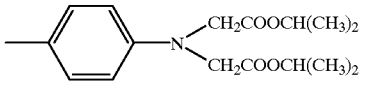 |
| F-26 | —CN | 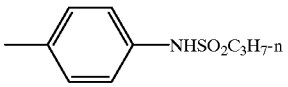 | 0 | 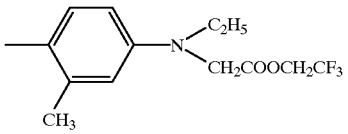 |
| F-27 | —CN | 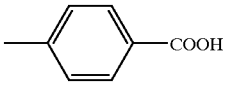 | 0 | 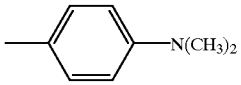 |
| F-28 | —CN | 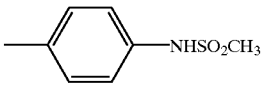 | 0 | 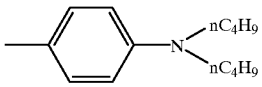 |

-continued

| | | | | |
|---|---|---|---|---|
| F-29 | —CN | 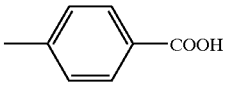 | 1 | 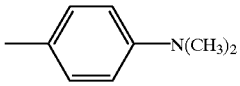 |
| F-30 | 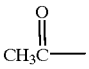 | 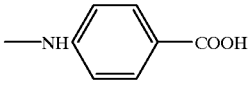 | 1 | 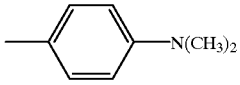 |
| F-31 | 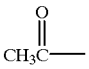 | 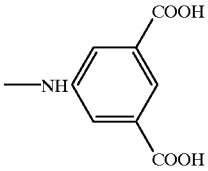 | 1 | 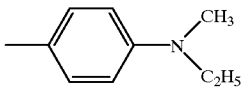 |
| F-32 | 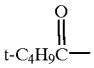 | 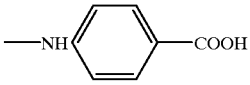 | 1 | 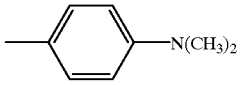 |
| F-33 | 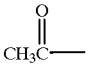 | 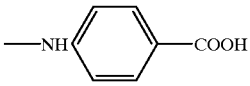 | 0 | 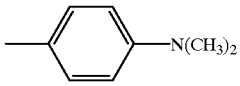 |
| F-34 | 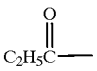 | 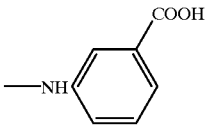 | 0 | 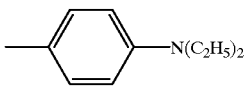 |
| F-35 | —CN | 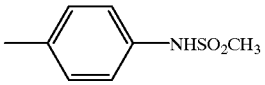 | 0 | 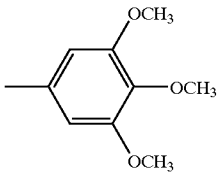 |

(F-36)

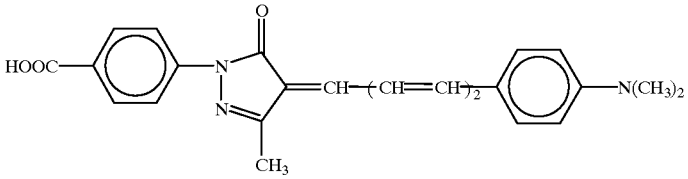

(F-37)

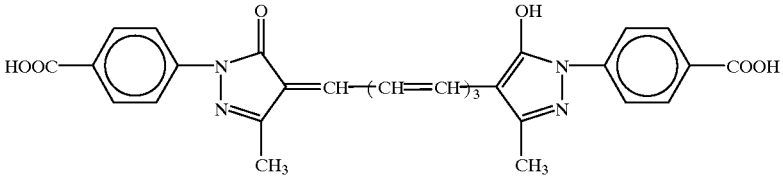

The present invention is characterized in that a layer containing a solid particle dispersion of the dyestuff compound of formula (FA) is coated nearer to the support with respect to the emulsion layer.

A method for preparing a solid particle dispersion of a dyestuff is described in WO 88/04794, EP 0276566A1 and JP-A 197943/1988 although it is generally prepared by pulverizing a dyestuff in a ball mill and stabilizing with a surfactant and gelatin.

The present invention employs the method for preparing a solid particle dispersion of a dyestuff according to JP-A 197943/1988. More particularly, a 1.5-liter bottle with a screw lid is charged with 434 ml of water and a 6.7% solution containing 53 g of a surfactant Triton X-200R (by Rohm & Haas). To the bottle are added 20 g of a dyestuff and 800 ml of zirconium oxide (ZrO) beads with a diameter 2 mm. The lid is tightened on the bottle, which is placed in a mill where the contents are milled for 4 days. The contents are then added to 160 g of a 12.5% gelatin aqueous solution. The mixture is milled in a roll mill for 10 minutes for reducing bubbles. The ZrO beads are removed from the mixture by filtration. By subsequent centrifugation, a fraction with a particle size of 1.0 $\mu$m is collected.

The dyestuff used herein preferably has a mean particle size of less than 2 $\mu$m, more preferably 0.01 to 1 $\mu$m.

In the dyestuff layer containing the dyestuff according to the invention, the coverage of the dyestuff is preferably 1 to 100 mg/$M^2$, more preferably 5 to 15 mg/$M^2$.

In the dyestuff layer, the coverage of hydrophilic colloid on one surface is preferably 20 to 2,000 mg/$m^2$, more preferably 40 to 1,000 mg/$m^2$, most preferably 40 to 400 mg/$m^2$.

If the silver halide photographic material according to the invention has a greater coverage of entire hydrophilic colloid, the coating solution must have a higher water content. This leads to an increased drying load, which is undesirable from the standpoint of rapid processing. Therefore, the coverage of entire hydrophilic colloid on one surface is preferably less than 3.5 g/$m^2$, more preferably 1 to 3 g/$m^2$.

From the standpoint of not increasing the coverage of entire hydrophilic colloid, the dyestuff according to the invention is desirably contained in the undercoat layer which is coated for the purpose of providing adhesion between the support and the silver halide emulsion layer.

The undercoat layer is coated by the following procedure, for example. On first undercoat layers on opposite surfaces of a support, second undercoat layers are coated and dried one by one side by a wire bar coating means. The support is preferably polyethylene terephthalate or cellulose triacetate film.

The support is preferably surface treated by corona discharge, glow discharge or UV irradiation for improving its adhesion to a hydrophilic colloid layer. Alternatively, the support is provided with an undercoat layer of styrene-butadiene or vinylidene chloride latex (first undercoat layer).

An undercoat layer may also be provided using a polyethylene swelling agent and gelatin in an organic solvent. The adhesion of these undercoat layers to hydrophilic colloid layers can be further improved by effecting surface treatment on the undercoat layers.

The undercoat layer used herein designates a silver halide grain-free gelatin layer formed on the above-mentioned undercoat layer, that is, second undercoat layer.

In the first undercoat layer according to the invention, styrene-butadiene copolymers, vinylidene chloride copolymers, water-soluble polyesters, and polyacrylates may be used as the hydrophobic polymer. Among these, the styrene-butadiene copolymers and vinylidene chloride copolymers are preferred, with the styrene-butadiene copolymers being more preferred. The styrene-butadiene copolymers may be copolymers of styrene and butadiene in a weight ratio of 9/1 to 1/9 and may further contain acrylic acid or the like as a third comonomer. The coating weight of the hydrophobic polymer in the undercoat layer is preferably 100 to 1,000 mg/$m^2$ while the undercoat layer is preferably dried at a temperature of 80 to 200° C.

The hydrophobic polymer contained in the undercoat layer is used in the form of an aqueous dispersion or latex. Suitable additives such as a crosslinking agent, surfactant, swelling agent, matte agent and antistatic agent may be added to the aqueous dispersion.

Examples of the crosslinking agent include triazine compounds as described in U.S. Pat. Nos. 3,325,287, 3,288,775, 3,549,377 and Belgian Patent No. 6,602,226; dialdehyde compounds as described in U.S. Pat. Nos. 3,291,624, 3,232,764, French Patent No. 1,543,694, and UKP 1,270,578; epoxy compounds as described in U.S. Pat. No. 3,091,537 and JP-B 26580/1974; vinyl compounds as described in U.S. Pat. No. 3,642,486; aziridine compounds as described in U.S. Pat. No. 3,392,024; ethylene imine compounds as described in U.S. Pat. No. 3,549,378; and methylol compounds. Preferred among others are dichlorotriazine derivatives.

In the second undercoat layer, the coating weight of hydrophilic colloid is preferably 20 mg/$m^2$ to 400 mg/$m^2$. The drying temperature is desirably above 80° C. in order to ensure adhesion to the first undercoat layer and usually below 180° C.

Screen

In forming images using the photosensitive material of the present invention, exposure is preferably performed by combining the photosensitive material with a screen using a fluorescent substance having a main peak at 300 to 500 nm.

Well-known fluorescent substances including $CaWO_4$, BaFCl:Eu, and LaOBr:Tm are described in Materials Chemistry and Physics, 16 (1987), 253–281, for example.

Screens having a main luminous peak below 400 nm are also described in JP-A 11804/1994 and WO 93/01521 although the screen is not limited to these examples.

The preferred fluorescent substance used herein has a luminous wavelength of less than 450 nm, more preferably less than 430 nm.

Typical fluorescent substances include M' phase $YTaO_4$ alone or having added thereto Gd, Sr, Bi, Pb, Ce, Se, Al, Rb, Ca, Cr, Cd or Nb; LaOBr having added thereto Gd, Tm, Gd and Tm, Gd and Ce, or Tb; HfZr oxide alone or having added thereto Ge, Ti or alkali metal; $Y_2O_3$ alone or having added thereto Gd or Eu; $Y_2O_2S$ having added thereto Gd; and various fluorescent substances having Gd, Tl or Ce added as an activator. Preferred are M' phase $YTaO_4$ alone or having added thereto Gd or Sr; LaOBr having added thereto Gd, Tm, or Gd and Tm; HfZr oxide alone or having added thereto Ge, Ti or alkali metal.

The fluorescent substance preferably has a mean particle size of 1 to 20 $\mu$m although the particle size may be altered in accordance with the desired sensitivity and preparation conditions. The coating weight of the fluorescent substance is preferably 400 to 2,000 g/$m^2$ although it may be altered in accordance with the desired sensitivity and image quality. A single intensifying screen may be provided with a particle size distribution varying from near the support to the surface. In this regard, it is generally known that larger particles are distributed at the surface. The fluorescent substance usually has a space packing factor of more than 40%, preferably more than 60%.

Where photographing is done with fluorescent layers disposed on opposite surfaces of the photosensitive material, the coating weight of fluorescent substance on the X-ray incident side may be different from the coating weight of fluorescent substance on the opposite side. In consideration of shielding by the intensifying screen on the X-ray incident side, it is known to reduce the coating weight of the intensifying screen on the X-ray incident side where a high sensitivity system is necessary.

The support of the screen used herein may be paper, metal plates and polymer sheets. Most often, flexible sheets of polyethylene terephthalate or the like are used. If necessary, a reflective agent or light-absorbing agent may be added to the support, or the support may be provided on the surface with a layer of a reflective agent or light-absorbing agent.

Also if necessary, the support may be provided on the surface with fine asperities or undercoated with an adhesive layer for increasing adhesion to a fluorescent layer or a conductive layer. Exemplary reflective agents include zinc oxide, titanium oxide, and barium sulfate while titanium oxide and barium sulfate are preferred because of the short luminous wavelength of the fluorescent substance. The reflective agent may be contained not only in the support or between the support and the fluorescent layer, but also in the fluorescent layer. Where the reflective agent is contained in the fluorescent layer, it is preferably localized near the support.

Examples of the binder used in the screen according to the invention include naturally occurring high molecular weight substances, for example, proteins such as gelatin, polysaccharides such as dextran and corn starch, and gum arabic; synthetic polymers, for example, polyvinyl butyral, polyvinyl acetate, polyurethane, polyalkyl acrylate, vinylidene chloride, nitrocellulose, fluorinated polymers, and polyesters, and mixtures and copolymers thereof. The preferred binder should have a high transmittance of light emitted by the fluorescent substance as a basic function. Preferred in this regard are gelatin, corn starch, acrylic polymers, fluorinated olefin polymers, polymers containing fluorinated olefin as a comonomer, and styrene/acrylonitrile copolymers. These binders may have a functional group crosslinkable with a crosslinking agent. Depending on the desired image quality, an agent for absorbing light emission from the fluorescent substance may be added to the binder or a low transmittance binder may be used. Exemplary absorbing agents are pigments, dyestuffs and UV absorbing compounds. The volume ratio of fluorescent substance to binder is generally from 1:5 to 50:1, preferably from 1:1 to 5:1. The ratio of fluorescent substance to binder may be constant or varied in a thickness direction.

The fluorescent layer is generally formed by dispersing a fluorescent substance in a binder solution and applying the coating dispersion. The solvent for the coating solution may be water or organic solvents such as alcohols, chlorinated hydrocarbons, and ketone, ester, and ether aromatic compounds alone or in admixture of two or more. The coating solution may further contain agents for stabilizing the dispersion of fluorescent particles (dispersion stabilizers) such as phthalic acid, stearic acid, caproic acid and surfactants and plasticizers such as phosphates, phthalates, glycolates, polyesters, and polyethylene glycol.

The screen used herein may be further provided with a protective layer on the fluorescent layer. The protective layer is generally formed by coating a protective solution on the fluorescent layer or by separately forming a protective film and laminating it. In the coating method, the protective layer may be coated at the same time as the fluorescent layer or after the fluorescent layer is coated and dried. The protective layer may use a material which is identical with or different from the binder of the fluorescent layer. The materials used in the protective layer include the materials exemplified as the binder of the fluorescent layer as well as cellulose derivatives, polyvinyl chloride, melamine, phenolic resins, and epoxy resins. Preferred materials are gelatin, corn starch, acrylic polymers, fluorinated olefin polymers, polymers containing fluorinated olefin as a comonomer, and styrene/acrylonitrile copolymers. The protective layer generally has a thickness of 1 to 20 $\mu$m, preferably 2 to 10 $\mu$m, more preferably 2 to 6 $\mu$m. The protective layer is preferably embossed on the surface. A matte agent may be present in the protective layer, and a material capable of scattering emitted light, for example, titanium oxide may be contained in the protective layer in accordance with the desired image quality.

Surface lubricity may be imparted to the protective layer of the screen used herein. Preferred lubricants are polysiloxane skeleton-containing oligomers and perfluoroalkyl-containing oligomers.

Electric conductivity may be imparted to the protective layer of the screen used herein. Useful conductive agents include white and transparent inorganic conductive materials and organic antistatic agents. Preferred inorganic conductive materials include ZnO powder and whiskers, $SnO_2$, and tin-doped indium oxide (ITO).

According to the invention, the photosensitive material is subject to rapid processing. By the rapid processing it is meant that the overall processing time taken from the entry of photosensitive material into a developer to the end of drying step, that is, dry-to-dry processing time is up to 50 seconds, preferably 20 to 50 seconds, more preferably 25 to 47 seconds. In general, development is done at 29 to 37° C. for 7 to 15 seconds, fixation at 25 to 35° C. for 7 to 15 seconds, water washing at 10 to 30° C. for 6 to 15 seconds, and drying at 50 to 60° C. for 7 to 15 seconds. The developer, fixer and washing water are replenished in an amount of 50 to 400 ml, 50 to 400 ml, and 50 to 400 ml per square meter of the photosensitive material, respectively.

No particular limits are imposed on the various addenda and construction of the photosensitive material of the invention as well as the processing thereof. Use may be made of the additives and methods described in JP-A 68539/1990 and other patent publications, for example.

| | Components | |
|---|---|---|
| 1 | Silver halide emulsion and its preparation | P8, LR, L25-P10, UR, L12 of JP-A 68539/1990; P2, LR, L10-P6, UR, L1 + P10, UL, L16-P11, LL, L19 of JP-A 24537/1991; JP Appln. 225637/1990 |
| 2 | Chemical sensitization | P10, UR, L13-LL, L16 of JP-A 68539/1990 JP Appln. 105035/1991 |
| 3 | Antifoggant, stabilizer | P10, LL, L17-P11, UL, L7 + P3, LL, L2-P4, LL of JP-A 68539/1990 |
| 4 | Toner | P2, LL, L7-P10, LL, L20 of JP-A 276539/1987 P6, LL, L15-P11, UR, L19 of JP-A 94249/1991 |
| 5 | Spectral sensitizing dye | P4, LR, L4-P8, LR of JP-A 68539/1990 |
| 6 | Surfactant, antistatic agent | P11, UL, L14-P12, UL, L9 of JP-A 68539/1990 |
| 7 | Matte agent, lubricant, plasticizer | P11, UL, L10-UR, L10 + P14, UL, L10-LR, L1 of JP-A 68539/1990 |
| 8 | Hydrophilic colloid | P12, UR, L11-LL, L16 of JP-A 68539/1990 |
| 9 | Hardener | P12, LL, L17-P13, UR, L6 of JP-A 68539/1990 |
| 10 | Support | P13, UR, L7-20 of JP-A 68539/1990 |
| 11 | Crossover cutting | P4, UR, L20-P14, UR of JP-A 264944/1990 |
| 12 | Dyestuff, mordant | P13, LR, L1-P16, LR of JP-A 68539/1990 |
| 13 | Polyhydroxybenzenes | P11, UL-P12, LL of JP-A 39948/1991: EP 452772A |
| 14 | Layer construction | JP-A 198041/1991 |
| 15 | Development | P16, UR, L7-P19, LL, L15 of JP-A 103037/1990; P3, LR, L5-P6, UR, L10 of JP-A 115837/1990 |

(Note: P: page, UL: upper left column, UR: upper right column, LL: lower left column, LR: lower right column, L: line)

EXAMPLE

Examples of the invention are given below by way of illustration and not by way of limitation. Mw is an average molecular weight.

Example 1

Seed crystal formulation

Emulsion T-1

To an aqueous solution containing 0.8 g of low molecular weight gelatin (average molecular weight 15,000) and 1.2 g of potassium bromide in 1.5 liters of water and kept at 30° C., with stirring, an aqueous solution containing 18 g of silver nitrate and an aqueous solution containing 12.6 g of potassium bromide and 2.4 g of gelatin (average molecular weight 15,000) were added over 60 seconds by the double jet method. An aqueous solution containing 10 g of potassium bromide was then added to the solution, which was heated to 50° C. over 20 minutes. Thereafter, 10 ml of an aqueous solution of 1N sodium hydroxide was added. Subsequently, 200 g of silver nitrate and potassium bromide were added over 32 minutes by the controlled double jet method while keeping pAg 8.2. The flow rate was accelerated such that the flow rate at the end of addition was 6.8 times the flow rate at the start of addition. After the solution was maintained at the temperature for 8 minutes for physical ripening, the temperature was lowered to 35° C. whereupon the soluble salts were removed by flocculation. The temperature was then raised to 40° C. whereupon 50 g of gelatin, 4.7 g of phenoxyethanol, and 1 mg of sodium thiosulfonate were added to the solution, which was adjusted to pH 5.7 with sodium hydroxide. Subsequent quench solidification yielded an emulsion T-1.

The thus obtained grains T-1 were tabular grains having a sphere equivalent diameter of 0.27±0.05 μm and a thickness of 0.1 μm on the total number average.

Emulsion T-2

To an aqueous solution containing 0.8 g of low molecular weight gelatin (average molecular weight 15,000) and 1.2 g of potassium bromide in 1.5 liters of water and kept at 30° C., 2 g of grafted polyalkylene oxide polymer having a molecular weight of 30,000 (Compound A-21) was added. With stirring, an aqueous solution containing 18 g of silver nitrate and an aqueous solution containing 12.6 g of potassium bromide and 2.4 g of gelatin (average molecular weight 15,000) were added over 60 seconds by the double jet method. An aqueous solution containing 10 g of potassium bromide was then added to the solution, which was heated to 50° C. over 20 minutes. Thereafter, 10 ml of an aqueous solution of 1N sodium hydroxide was added. Subsequently, 200 g of silver nitrate and potassium bromide were added over 32 minutes by the controlled double jet method while keeping pAg 8.2. The flow rate was accelerated such that the flow rate at the end of addition was 6.8 times the flow rate at the start of addition. After the solution was maintained at the temperature for 8 minutes for physical ripening, the temperature was lowered to 35° C. whereupon the soluble salts were removed by flocculation. The temperature was then raised to 40° C. whereupon 50 g of gelatin, 4.7 g of phenoxyethanol, and 1 mg of sodium thiosulfonate were added to the solution, which was adjusted to pH 5.7 with sodium hydroxide. Subsequent quench solidification yielded an emulsion T-2.

The thus obtained grains T-2 were tabular grains having a sphere equivalent diameter of 0.23±0.03 μm and a thickness of 0.1 μm on the total number average.

Emulsion T-3

To an aqueous solution containing 0.8 g of low molecular weight gelatin (average molecular weight 15,000), 1.2 g of potassium bromide, and 0.2 g of potassium iodide in 1.5 liters of water and kept at 30° C., 2 g of grafted polyalkylene oxide polymer having a molecular weight of 30,000 (Compound A-21) was added. With stirring, an aqueous solution containing 18 g of silver nitrate and an aqueous solution containing 12.6 g of potassium bromide and 2.4 g of gelatin (average molecular weight 15,000) were added over 60 seconds by the double jet method. An aqueous solution containing 10 g of potassium bromide was then added to the solution, which was heated to 50° C. over 20 minutes. Thereafter, 10 ml of an aqueous solution of 1N sodium hydroxide was added. Subsequently, 200 g of silver nitrate and potassium bromide were added over 32 minutes by the controlled double jet method while keeping pAg 8.6. The flow rate was accelerated such that the flow rate at the end of addition was 6.8 times the flow rate at the start of addition. After the solution was maintained at the temperature for 8 minutes for physical ripening, the temperature was lowered to 35° C. whereupon the soluble salts were removed by flocculation. The temperature was then raised to 40° C. whereupon 50 g of gelatin, 4.7 g of phenoxyethanol, and 1 mg of sodium thiosulfonate were added to the solution, which was adjusted to pH 5.7 with sodium hydroxide. Subsequent quench solidification yielded an emulsion T-3.

The thus obtained grains T-3 were tabular grains having a sphere equivalent diameter of 0.23±0.03 βm and a thickness of 0.2 μm on the total number average.

Growth using seed crystals

Emulsion F-1

To 810 ml of water was added 24 g of gelatin. To the solution kept at 74° C. was added 27 g of seed crystals T-1. After 3 minutes from the addition, 2.6 g of potassium bromide was added. Thereafter, an aqueous solution containing 32.7 g of silver nitrate and 188 ml of a halide solution (a1) in Table 3 were added over 25 minutes to effect a first stage of growth. At this stage, the flow rate was constant. While keeping pAg 8.10, an aqueous solution containing 160 g of silver nitrate and a halide solution (a2) in Table 3 were added over 50 minutes to effect a second stage of growth. At this stage, the flow rate was accelerated such that the flow rate at the end of addition was 5.7 times the flow rate at the start of addition. At the end of addition, 18 ml of 1N potassium thiocyanate solution was added. After the solution was maintained at the temperature for 5 minutes for physical ripening, the temperature was lowered to 35° C. whereupon the soluble salts were removed by flocculation. The temperature was then raised to 40° C. whereupon 61 g of gelatin, 3.3 g of phenoxyethanol, and a thickener were added to the solution, which was adjusted to pH 6.1 and pAg 8.4 with sodium hydroxide and potassium bromide.

The emulsion thus prepared was heated at 50° C. and 4.8 mg of sodium ethylthiosulfonate was added. After 2 minutes, 150 mg of 4-hydroxy-6-methyl-1,3,3a,7-tetraazaindene was added. After 4 minutes, 353 mg of compound A-1 was added as a sensitizing dye, and 2.2 mg of chloroauric acid and 73 mg of potassium thiocyanate were then added, and 1 mg of sodium thiosulfate and 1.8 mg of selenium compound A-3 were further added. The solution was ripened for 27 minutes. Thereafter, 22 mg of sodium sulfite was added to the solution, which was further ripened. After 40 minutes, 1.8 g of 4-hydroxy-6-methyl-1,3,3a,7-tetraazaindene was added to the solution. Subsequent quench solidification yielded an emulsion F-1.

Emulsion F-2

An emulsion F-2 was prepared by the same procedure as emulsion F-1 except that the halide solution used in the first stage of growth was a halide solution (b1) in Table 3 and the halide solution used in the second stage of growth was a halide solution (b2) in Table 3.

Emulsion F-3

An emulsion F-3 was prepared by the same procedure as emulsion F-1 except that the halide solution used in the first stage of growth was a halide solution (cl) in Table 3 and the halide solution used in the second stage of growth was a halide solution (c2) in Table 3.

Emulsion F-4

An emulsion F-4 was prepared by the same procedure as emulsion F-1 except that the halide solution used in the first stage of growth was a halide solution (dl) in Table 3 and the halide solution used in the second stage of growth was a halide solution (d2) in Table 3.

Emulsion F-5

An emulsion F-5 was prepared by the same procedure as emulsion F-1 except that the halide solution used in the first stage of growth was a halide solution (e1) in Table 3 and the halide solution used in the second stage of growth was a halide solution (e2) in Table 3.

Emulsion G-1

To 840 ml of water was added 24 g of gelatin. To the solution kept at 74° C. was added 20 g of seed crystals T-2. After 3 minutes from the addition, 2.6 g of potassium bromide was added. Thereafter, an aqueous solution containing 32.7 g of silver nitrate and 188 ml of a halide solution (a1) in Table 3 were added over 25 minutes to effect a first stage of growth. At this stage, the flow rate was constant. After 10 mg of sodium ethylthiosulfonate was added, 0.9 mg of thiourea dioxide was added. While keeping pAg 8.00, an aqueous solution containing 161.5 g of silver nitrate and a halide solution (a2) in Table 3 were added over 50 minutes to effect a second stage of growth. At this stage, the flow rate was accelerated such that the flow rate at the end of addition was 5.7 times the flow rate at the start of addition. At the end of addition, 12 ml of 1N potassium thiocyanate solution was added. After the solution was maintained at the temperature for 5 minutes for physical ripening, the temperature was lowered to 35° C. whereupon the soluble salts were removed by flocculation. The temperature was then raised to 40° C. whereupon 61 g of gelatin, 3.3 g of phenoxyethanol, and a thickener were added to the solution, which was adjusted to pH 6.1 and pAg 7.8 with sodium hydroxide and potassium bromide.

The emulsion thus prepared was heated at 50° C. and 4.8 mg of sodium ethylthiosulfonate was added. After 2 minutes, 150 mg of 4-hydroxy-6-methyl-1,3,3a,7-tetraazaindene was added. After 4 minutes, 353 mg of compound A-1 was added as a sensitizing dye, and 2.2 mg of chloroauric acid and 73 mg of potassium thiocyanate were then added, and 1 mg of sodium thiosulfate and 1.8 mg of selenium compound A-3 were further added. The solution was ripened for 27 minutes. Thereafter, 22 mg of sodium sulfite was added to the solution, which was further ripened. After 40 minutes, 1.8 g of 4-hydroxy-6-methyl-1,3,3a,7-tetraazaindene was added to the solution. Subsequent quench solidification yielded an emulsion G-1.

Emulsion G-2

An emulsion G-2 was prepared by the same procedure as emulsion G-1 except that the halide solution used in the first stage of growth was a halide solution (b1) in Table 3 and the halide solution used in the second stage of growth was a halide solution (b2) in Table 3.

Emulsion G-3

An emulsion G-3 was prepared by the same procedure as 20 emulsion G-1 except that the halide solution used in the first stage of growth was a halide solution (cl) in Table 3 and the halide solution used in the second stage of growth was a halide solution (c2) in Table 3.

Emulsion G-4

An emulsion G-4 was prepared by the same procedure as emulsion G-1 except that the halide solution used in the first stage of growth was a halide solution (dl) in Table 3 and the halide solution used in the second stage of growth was a halide solution (d2) in Table 3.

Emulsion G-5

An emulsion G-5 was prepared by the same procedure as emulsion G-1 except that the halide solution used in the first stage of growth was a halide solution (el) in Table 3 and the halide solution used in the second stage of growth was a halide solution (e2) in Table 3.

Emulsion H-1

To 840 ml of water was added 24 g of gelatin. To the solution kept at 74° C. was added 20 g of seed crystals T-3. After 3 minutes from the addition, 2.6 g of potassium bromide was added. Thereafter, an aqueous solution containing 32.7 g of silver nitrate and 188 ml of a halide solution (a'1) in Table 4 were added over 25 minutes to effect a first stage of growth. At this stage, the flow rate was constant. After 10 mg of sodium ethylthiosulfonate was added, 0.9 mg of thiourea dioxide was added. While keeping pAg 8.00, an aqueous solution containing 161.5 g of silver nitrate and a halide solution (a'2) in Table 4 were added over 50 minutes to effect a second stage of growth. At this stage, the flow rate was accelerated such that the flow rate at the end of addition was 5.7 times the flow rate at the start of addition. At the end of addition, 18 ml of 1N potassium thiocyanate solution was added. After the solution was maintained at the temperature for 5 minutes for physical ripening, the temperature was lowered to 35° C. whereupon the soluble salts were removed by flocculation. The temperature was then raised to 40° C. whereupon 61 g of gelatin, 3.3 g of phenoxyethanol, and a thickener were added to the solution, which was adjusted to pH 6.1 and pAg 7.8 with sodium hydroxide and potassium bromide.

The emulsion thus prepared was heated at 50° C. and 4.8 mg of sodium ethylthiosulfonate was added. After 2 minutes, 150 mg of 4-hydroxy-6-methyl-1,3,3a,7-tetraazaindene was added. After 4 minutes, 353 mg of compound A-1 was added as a sensitizing dye, and 2.2 mg of chloroauric acid and 73 mg of potassium thiocyanate were then added, and 1 mg of sodium thiosulfate and 1.8 mg of selenium compound A-3 were further added. The solution was ripened for 27 minutes. Thereafter, 22 mg of sodium sulfite was added to the solution, which was further ripened. After 40 minutes, 1.8 g of 4-hydroxy-6-methyl-1,3,3a,7-tetraazaindene was added to the solution. Subsequent quench solidification yielded an emulsion H-1.

Emulsion H-2

An emulsion H-2 was prepared by the same procedure as emulsion H-1 except that the halide solution used in the first stage of growth was a halide solution (b'1) in Table 4 and the halide solution used in the second stage of growth was a halide solution (b'2) in Table 4.

Emulsion H-3

An emulsion H-3 was prepared by the same procedure as emulsion H-1 except that the halide solution used in the first stage of growth was a halide solution (c'1 ) in Table 4 and the halide solution used in the second stage of growth was a halide solution (c'2) in Table 4.

Emulsion H-4

An emulsion H-4 was prepared by the same procedure as emulsion H-1 except that the halide solution used in the first stage of growth was a halide solution (d'1) in Table 4 and the halide solution used in the second stage of growth was a halide solution (d'2) in Table 4.

Emulsion H-5

An emulsion H-5 was prepared by the same procedure as emulsion H-1 except that the halide solution used in the first stage of growth was a halide solution (e'1) in Table 4 and the halide solution used in the second stage of growth was a halide solution (e'2) in Table 4.

In emulsions F-1 to F-5 and G-1 to G-5, grains having an aspect ratio of at least 5 accounted for 80% of the entire grains. For all the grains, the emulsions had a mean projected area diameter of 1.25 $\mu$m with a coefficient of variation of 28%, a mean thickness of 0.20 μm, and a mean aspect ratio of 7.

In emulsions H-1 to H-5, grains having an aspect ratio of up to 5 accounted for 80% of the entire grains. For all the grains, the emulsions had a mean projected area diameter of 0.85 μm with a coefficient of variation of 25%, a mean thickness of 0.30 μm, and a mean aspect ratio of 4.0.

In Tables 3 and 4, an iodine content during growth and a final iodine content at the end of growth (that is, an iodine content of final grains) are also reported.

TABLE 3

| Designation No. | KBr (30%) solution (ml) | KI (20%) solution (ml) | Diluent water (ml) | Total amount (ml) | Iodine content during growth (mol %) | Final iodine content (mol %) |
|---|---|---|---|---|---|---|
| a1 | 75.73 | 0.00 | 111.77 | 187.50 | 0.00 | 0.000 |
| a2 | 374.22 | 0.00 | 85.78 | 460.00 | 0.00 | |
| b1 | 74.96 | 1.61 | 110.93 | 187.50 | 1.02 | 1.000 |
| b2 | 370.45 | 7.89 | 81.66 | 460.00 | 1.02 | |
| c1 | 74.20 | 3.21 | 111.09 | 187.50 | 2.06 | 2.020 |
| c2 | 366.69 | 15.77 | 77.54 | 460.00 | 2.06 | |
| d1 | 73.51 | 4.66 | 109.34 | 187.50 | 3.03 | 2.970 |
| d2 | 363.22 | 23.02 | 73.76 | 460.00 | 3.03 | |
| e1 | 73.27 | 5.14 | 109.08 | 187.50 | 3.35 | 3.280 |
| e2 | 362.16 | 25.23 | 72.60 | 460.00 | 3.35 | |

TABLE 4

| Designation No. | KBr (30%) solution (ml) | KI (20%) solution (ml) | Diluent water (ml) | Total amount (ml) | Iodine content during growth (mol %) | Final iodine content (mol %) |
|---|---|---|---|---|---|---|
| a'1 | 75.73 | 0.00 | 111.77 | 187.50 | 0.00 | 0.0002 |
| a'2 | 374.22 | 0.00 | 85.78 | 460.00 | 0.00 | |
| b'1 | 74.96 | 1.61 | 110.93 | 187.50 | 1.02 | 1.001 |
| b'2 | 370.45 | 7.89 | 81.66 | 460.00 | 1.02 | |
| c'1 | 74.20 | 3.21 | 111.09 | 187.50 | 2.06 | 2.021 |
| c'2 | 366.69 | 15.77 | 77.54 | 460.00 | 2.06 | |
| d'1 | 73.51 | 4.66 | 109.34 | 187.50 | 3.03 | 2.971 |
| d'2 | 363.22 | 23.02 | 73.76 | 460.00 | 3.03 | |
| e'1 | 73.27 | 5.14 | 109.08 | 187.50 | 3.35 | 3.285 |
| e'2 | 362.16 | 25.23 | 72.60 | 460.00 | 3.35 | |

Preparation of emulsion coating solution

An emulsion coating solution was prepared by adding the following chemicals to the chemically sensitized emulsion in an amount per mol of the silver halide.

| | |
|---|---|
| Gelatin (including gelatin in emulsion) | 104 g |
| Dextran (Mw = 39,000) | 19 g |
| Sodium polystyrenesulfonate (Mw = 600,000) | 1.2 g |
| Compound A-4 | 46 mg |
| Compound A-5 | 8.9 g |
| Snowtex C | 5.7 g |
| Compound A-8 | 35 mg |
| Compound A-7 | 13 mg |
| Compound A-6 | 88 mg |
| Ethyl acrylate/methacrylic acid (97/3) copolymer latex | 3.9 g |
| Hardener | 1.4 g |

Preparation of surface protective layer coating solution

A coating solution for a surface protective layer was prepared by blending the following components such that they were coated in the following coverage.

| | |
|---|---|
| Gelatin | 780 mg/m$^2$ |
| Sodium polyacrylate (Mw = 400,000) | 25 mg/m$^2$ |
| Compound A-2 | 43 mg/m$^2$ |
| Compound A-10 | 18 mg/m$^2$ |
| Compound A-11 | 45 mg/m$^2$ |
| Compound A-13 | 0.9 mg/m$^2$ |
| Compound A-15 | 5 mg/m$^2$ |
| Compound A-20 | 26 mg/m$^2$ |
| Polymethylmethacrylate (mean particle size 2.5 μm) | 87 mg/m$^2$ |
| Proxisel | 0.5 mg/m$^2$ |
| Potassium polystyrenesulfonate (Mw = 600,000) | 0.9 mg/m$^2$ |
| Compound A-12 | 1 mg/m$^2$ |
| Compound A-14 (adjusted to pH 6.8 with NaOH) | 0.5 mg/m$^2$ |

Preparation of support (1) Preparation of dyestuff dispersion B for undercoat layer Compound A-17 was milled in a ball mill by the method described in JP-A 197943/1988. More specifically, a 2-liter ball mill was charged with 434 ml of water and 791 ml of an aqueous solution of 6.7% surfactant Triton® TX-200 (by Rohm & Haas). To the solution were added 20 g of the dyestuff and 400 ml of zirconium oxide ($ZrO_2$) beads with a diameter 2 mm. The contents were milled for 4 days. The contents were then combined with 160 g of a 12.5% gelatin aqueous solution. After deaeration, the $ZrO_2$ beads were removed from the mixture by filtration. On analysis of the thus obtained dyestuff dispersion, the dyestuff had been pulverized so as to have a wide particle size distribution ranging from 0.05 μm to 1.15 μm and a mean particle size of 0.37 μm. Subsequent centrifugation removed dyestuff particles with a diameter of more than 0.9 μm. A dyestuff dispersion B was obtained in this way.

(2) Preparation of support

A biaxially oriented polyethylene terephthalate film of 175 μm thick was subject to a corona discharge. A first undercoat layer of the composition shown below was coated on one surface of the film to a coverage of 4.9 ml/m$^2$ by a wire bar coater and dried at 185° C. for one minute. The first undercoat layer was similarly formed on the other surface of the film. The polyethylene terephthalate used contained 0.04% by weight of compound A-9.

| | |
|---|---|
| Butadiene-styrene copolymer latex (solids 40%, butadiene/styrene weight ratio = 31/69) | 158 ml |
| 4% sodium 2,4-dichloro-6-hydroxy-s-triazine solution | 41 ml |
| Distilled water | 801 ml |

The latex contained 0.4% by weight based on the latex solids of compound A-18 as an emulsifying dispersant.

(3) Coating of undercoat layer

Then second undercoat layers of the composition shown below were coated on the first undercoat layers on the opposite surfaces of the film one by one side to the following coverage by a wire bar coater and dried at 55° C.

| | |
|---|---|
| Gelatin | 80 mg/m$^2$ |
| Dye dispersion B (as dyestuff solids) | 8 mg/m$^2$ |
| Compound A-19 | 1.8 mg/m$^2$ |
| Compound A-16 | 0.27 mg/m$^2$ |
| Matte agent: polymethyl methacrylate, mean particle size 2.5 μm | 2.5 mg/m$^2$ |

Preparation of photographic material

On the thus prepared support, the emulsion layer and the surface protective layer were coated to both the surfaces by the co-extrusion method so as to give three different silver coverages of 0.8 g/m$^2$, 1.7 g/m$^2$, and 2.4 g/m$^2$ per one surface, obtaining coated samples of photographic material. In all the samples, a dyestuff emulsion (a) was added so as to give 10 mg/m$^2$ of compound A-9. The surface protective layer was 0.8 μm thick.

Preparation of dyestuff emulsion (a)

In 333 g of ethyl acetate, 60 g of compound A-9, 62.8 g of 2,4-diaminophenol, and 62.8 g of dicyclohexylphthalate were dissolved at 60° C. Then 65 ml of a 5% aqueous solution of sodium dodecylbenzenesulfonate, 94 g of gelatin, and 581 ml of water were added. Using a dissolver, the contents were emulsified and dispersed at 60° C. for 30 minutes.

Then 2 g of methyl p-hydroxybenzoate and 6 liters of water were added to the solution, which was cooled to 40° C. Using a ultrafiltration laboratory module ACP1050 by Asahi Chemicals K.K., the solution was concentrated until a total weight of 2 kg was reached. Adding 1 g of methyl p-hydroxybenzoate yielded dyestuff emulsion (a).

The compounds used herein are identified below.

Compound A-1

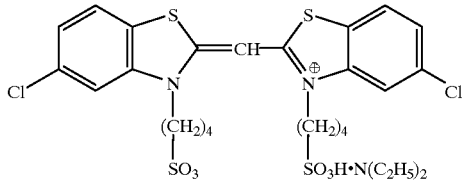

Compound A-2

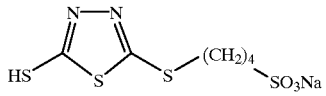

Compound A-3

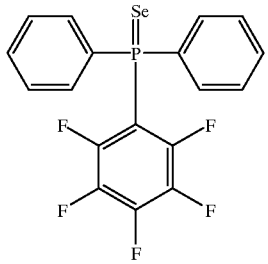

Compound A-4

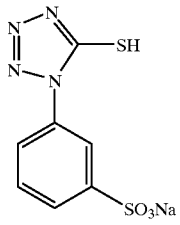

Compound A-5

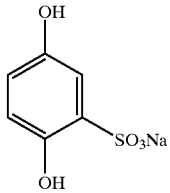

Compound A-6

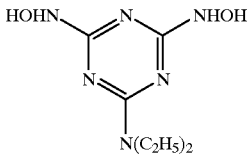

Compound A-7

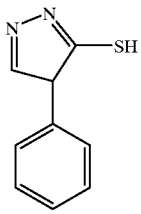

-continued

Compound A-8

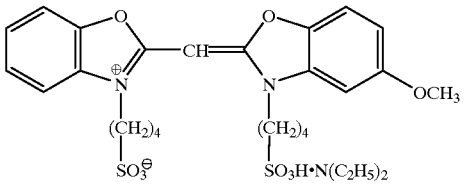

Compound A-9

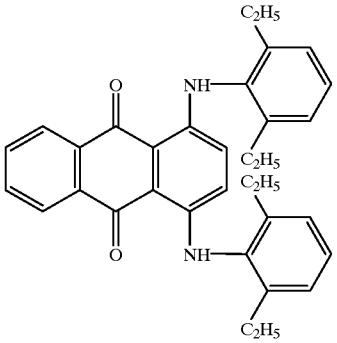

Compound A-10

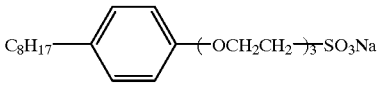

Compound A-11

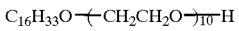

Compound A-12

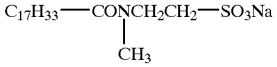

Compound A-13

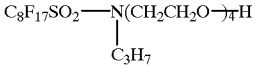

Compound A-14

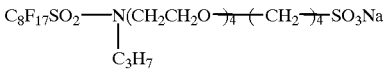

Compound A-15

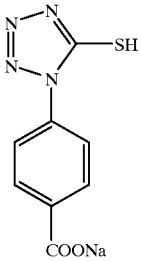

Compound A-16

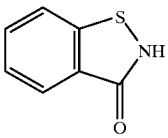

-continued

Compound A-17

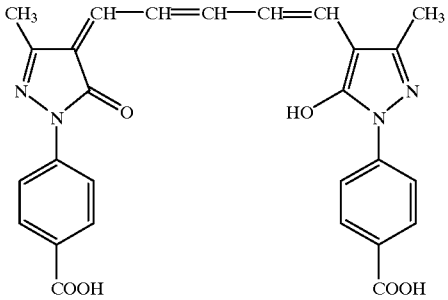

Compound A-18

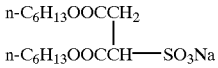

Compound A-19

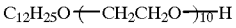

Compound A-20

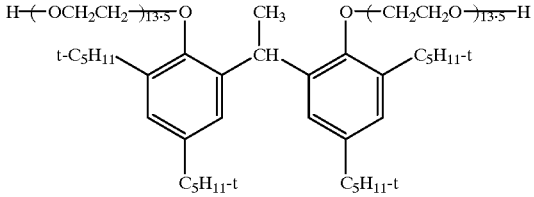

Compound A-21

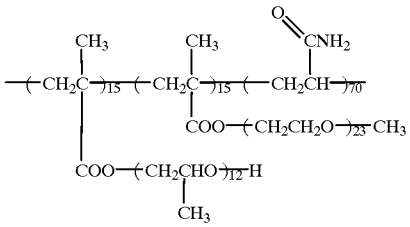

Photoagrahic test

Each coated sample was set in Hi-Screen B2 having a center luminous wavelength of 430 nm (by Kyokko K.K.) and exposed for 100 msec. at an X-ray voltage of 80 kV and a current of 160 mA. The exposed sample was developed with a developer (1) of the formulation shown below at 35° C. for 8 seconds, and thereafter, fixed, washed with water and dried. These steps were fixation at 30° C. for 8 seconds, water washing at 25° C. for 7 seconds, and drying at 55° C. for 7 seconds. The fixer used was CE-F30 by Fuji Photo-Film Co., Ltd. The washing water was city water.

| Developer (1) | |
|---|---|
| 1-phenyl-3-pyrazolidone | 1.5 g |
| Hydroquinone | 30 g |
| 5-nitroindazole | 0.25 g |
| Potassium bromide | 3.0 g |
| Sodium sulfite anhydride | 50 g |
| Sodium hydroxide | 30 g |
| Boric acid | 5 g |
| Glutaraldehyde | 10 g |
| Water to make (adjusted to pH 10.2) | 1 liter |

Each of the coated samples was examined for crossover light quantity, dye stain by sensitizing dye, and sensitivity.

Crossover light cut quantity

A quantity of crossover light cut was measured by directing only light emission from the front side screen to the photographic material for exposure. After exposure, the back side emulsion was removed and the front side emulsion was measured for density. Sensitivity L1 is defined as an inverse of an exposure necessary to give a density of the fog density (Fog)+0.3. Next, sensitivity L2 was similarly determined by removing the front side emulsion and measuring the density of the back side emulsion. The crossover light cut quantity AL is calculated according to the equation:

$$\Delta L=[(L1-L2)/L1]\times 100\%$$

The greater the value of ΔL, the less becomes the image unsharpness.

Dye stain

The photographic material processed as above was visually observed. It was rated "O" when not contaminated, "Δ" when somewhat contaminated, and "X" when contaminated.

Sensitivity

The photographic material was exposed using the same screens as above on both sides. Sensitivity is defined as an inverse of an exposure necessary to give a density of the fog density (Fog)+1.0 and expressed in a relative value based on 100 for the sample coated with emulsion F-1 to a silver coverage of 1.7 g/m$^2$.

The results are shown in Tables 5 to 7.

TABLE 5

| Coated sample No. | Emulsion used | Polymer used during nucleation (1) | Iodine content of final grains (mol %) | Silver coverage (g/m$^2$) | Crossover cut (%) | Dye Stain | Sensitivity |
|---|---|---|---|---|---|---|---|
| 1 | F-1 | not | 0 | 0.8 | 31 | ○ | 63 |
| 2 | F-1 | not | 0 | 1.7 | 45 | ○ | 100 |
| 3 | F-1 | not | 0 | 2.4 | 52 | X | 123 |
| 4 | F-2 | not | 1 | 0.8 | 37 | ○ | 66 |
| 5* | F-2 | not | 1 | 1.7 | 50 | ○ | 105 |
| 6 | F-2 | not | 1 | 2.4 | 56 | X | 129 |
| 7 | F-3 | not | 2.02 | 0.8 | 40 | ○ | 69 |
| 8* | F-3 | not | 2.02 | 1.7 | 52 | ○ | 110 |
| 9 | F-3 | not | 2.02 | 2.4 | 58 | X | 135 |
| 10 | F-4 | not | 2.97 | 0.8 | 43 | ○ | 72 |
| 11* | F-4 | not | 2.97 | 1.7 | 54 | Δ | 115 |
| 12 | F-4 | not | 2.97 | 2.4 | 60 | X | 141 |
| 13 | F-5 | not | 3.28 | 0.8 | 44 | ○ | 69 |
| 14 | F-5 | not | 3.28 | 1.7 | 56 | X | 110 |
| 15 | F-5 | not | 3.28 | 2.4 | 62 | X | 135 |

*invention

TABLE 6

| Coated sample No. | Emulsion used | Polymer used during nucleation (1) | Iodine content of final grains (mol %) | Silver coverage (g/m$^2$) | Crossover cut (%) | Dye Stain | Sensitivity |
|---|---|---|---|---|---|---|---|
| 16 | G-1 | occurred | 0 | 0.8 | 31 | ○ | 81 |
| 17 | G-1 | occurred | 0 | 1.7 | 45 | ○ | 130 |
| 18 | G-1 | occurred | 0 | 2.4 | 52 | X | 160 |
| 19 | G-2 | occurred | 1 | 0.8 | 37 | ○ | 85 |
| 20* | G-2 | occurred | 1 | 1.7 | 50 | ○ | 135 |
| 21 | G-2 | occurred | 1 | 2.4 | 56 | X | 166 |
| 22 | G-3 | occurred | 2.02 | 0.8 | 40 | ○ | 88 |
| 23* | G-3 | occurred | 2.02 | 1.7 | 52 | ○ | 140 |
| 24 | G-3 | occurred | 2.02 | 2.4 | 58 | X | 172 |
| 25 | G-4 | occurred | 2.97 | 0.8 | 43 | ○ | 91 |
| 26* | G-4 | occurred | 2.97 | 1.7 | 54 | Δ | 145 |
| 27 | G-4 | occurred | 2.97 | 2.4 | 60 | X | 178 |
| 28 | G-5 | occurred | 3.28 | 0.8 | 44 | ○ | 88 |
| 29 | G-5 | occurred | 3.28 | 1.7 | 56 | X | 140 |
| 30 | G-5 | occurred | 3.28 | 2.4 | 62 | X | 172 |

*invention

TABLE 7

| Coated sample No. | Emulsion used | Iodine content of final grains (mol %) | Silver coverage (g/m$^2$) | Crossover cut (%) | Dye Stain | Sensitivity |
|---|---|---|---|---|---|---|
| 31 | H-1 | 0.0002 | 0.8 | 31 | ○ | 57 |
| 32 | H-1 | 0.0002 | 1.7 | 45 | ○ | 90 |
| 33 | H-1 | 0.0002 | 2.4 | 52 | X | 110 |
| 34 | H-2 | 1.001 | 0.8 | 37 | ○ | 60 |
| 35 | H-2 | 1.001 | 1.7 | 50 | ○ | 95 |

TABLE 7-continued

| Coated sample No. | Emulsion used | Iodine content of final grains (mol %) | Silver coverage ($g/m^2$) | Crossover cut (%) | Dye Stain | Sensitivity |
|---|---|---|---|---|---|---|
| 36 | H-2 | 1.001 | 2.4 | 56 | X | 115 |
| 37 | H-3 | 2.021 | 0.8 | 40 | ○ | 63 |
| 38 | H-3 | 2.021 | 1.7 | 52 | ○ | 99 |
| 39 | H-3 | 2.021 | 2.4 | 58 | X | 118 |
| 40 | H-4 | 2.971 | 0.8 | 43 | ○ | 66 |
| 41 | H-4 | 2.971 | 1.7 | 54 | Δ | 102 |
| 42 | H-4 | 2.971 | 2.4 | 60 | X | 121 |
| 43 | H-5 | 3.285 | 0.8 | 44 | ○ | 69 |
| 44 | H-5 | 3.285 | 1.7 | 56 | X | 105 |
| 45 | H-5 | 3.285 | 2.4 | 62 | X | 125 |

It is evident that samples having a silver coverage and an iodine content of silver halide grains at the end of nucleus growth falling within the ranges of the invention are excellent in all the properties of sharpness, dye stain, and sensitivity. With respect to sensitivity, emulsions G-1 to G-5 which were grown on seed crystals (nuclei) formed using polyalkylene oxide belonging to the polymer of the general formula (1) showed about 30% higher sensitivity than emulsions F-1 to F-5 which did not use polyalkylene oxide. This sensitivity difference is higher than the sensitivity increase achieved by increasing the iodine content in the group of emulsions F-1 to F-5.

In contrast, as the silver coverage decreases below the range of the invention, crossover and sensitivity become worse. As the silver coverage increases beyond the range of the invention, dye stain becomes worse. As the iodine content decreases below the range of the invention, crossover becomes worse. As the iodine content increases beyond the range of the invention, dye stain becomes worse.

Emulsions H-1 to H-5 using iodine-containing nuclei are inferior in sensitivity to emulsions F-1 to F-5 and G-1 to G-5.

Example 2

The procedure of Example 1 was repeated except that the photosensitive material was processed by means of an automatic processor under conditions as described below. Equivalent results were confirmed by similar tests.

Processor:

An automatic processor model FPM-9000 by Fuji Photo-Film Co., Ltd. was modified by exchanging a drive motor and gear box to increase the feed speed.

Processing:

Processing solutions having the following formulation were used.

| Developer concentrate | |
|---|---|
| Potassium hydroxide | 56.6 g |
| Sodium sulfite | 200 g |
| Diethylenetriaminepentaacetic acid | 6.7 g |
| Potassium carbonate | 16.7 g |
| Boric acid | 10 g |
| Hydrocuinone | 83.3 g |
| Diethylene glycol | 40 g |
| 4-hydroxymethyl-4-methylphenyl-pyrazolidone | 22.0 g |
| 5-methylbenzotriazole | 2 g |
| Water to make (adjusted to pH 10.6) | 1 liter |

-continued

| Fixer concentrate | |
|---|---|
| Ammonium thiosulfate | 560 g |
| Sodium sulfite | 60 g |
| Disodium ethylenediaminetetraacetate dihydrate | 0.1 g |
| Sodium hydroxide | 24 g |
| Water to make (adjusted to pH 5.1 with acetic acid) | 1 liter |

At the start of development, the tanks of the processor were filled with processing solutions as follows.

Developing tank: A developer was prepared by diluting 33 ml of the developer concentrate of the above formulation with 667 ml of water, adding 10 ml of a starter containing 2 g of potassium bromide and 1.8 g of acetic acid thereto, and adjusting to pH 10.25.

Fixing tank: A fixer was prepared by diluting 200 ml of the fixer concentrate of the above formulation with 800 ml of water.

Processing speed: dry-to-dry processing time 35 seconds

Developing temperature/time: 35° C./9 sec.

Fixing temperature/time: 32° C./9 sec.

Washing temperature/time: 25° C./7 sec.

Drying temperature/time: 55° C./10 sec.

Replenishment: developer 21 ml/10 in.×12 in. size fixer 30 ml/10 in.×12 in. size The washing water was city water.

Example 3

The procedure of Example 1 was repeated except that the photosensitive material was processed by means of an automatic processor under conditions as described below. Equivalent results were confirmed by similar tests.

Processor: automatic processor model CEPROS-30 by Fuji Photo-Film Co., Ltd.

Processing:

Developer formulation

| Part A | |
|---|---|
| Potassium hydroxide | 270 g |
| Potassium sulfite | 1125 g |
| Diethylenetriaminepentaacetic acid | 30 g |
| Sodium carbonate | 450 g |
| Boric acid | 75 g |
| Hydroquinone | 405 g |
| 4-methyl-4-hydroxymethyl-1-phenyl-3-pyrazolidone | 30 g |

-continued

| | |
|---|---|
| Diethylene glycol | 150 g |
| 1-(diethylamino)ethyl-5-mercaptotetrazole | 1 g |
| Water to make | 4.7 liters |
| Part B | |
| Triethylene glycol | 700 g |
| 5-nitroindazole | 4 g |
| Acetic acid | 90 g |
| 1-phenyl-3-pyrazolidone | 50 g |
| 3,3-dithiobishydrocinnamic acid | 6 g |
| Water to maake | 850 ml |
| Part C | |
| Glutaraldehyde | 75 g |
| Potassium metabisulfite | 75 g |
| Water to make | 850 ml |

A replenisher was formulated to about pH 10.5 by adding water to Parts A, B, and C to a total volume of 15 liters. The developer cartridge was filled with the replenisher and loaded in the processor CEPROS-30. Specifically, the replenisher consisting of 31.3 ml of Part A, 5.7 ml of Part B, 5.7 ml of Part C and 57.3 ml of water (total 100 ml) was fed to the tank whenever 10 sheets of 10 in.×12 in. film size, that is, 10 ml per quarter-size film.

The developer mother solution used was prepared by adding 150 g of KBr and 150 g of acetic acid to 1.5 liters of the replenisher. The processor CEPROS-30 was operated at 35° C. and a dry-to-dry time of 46 seconds in a running mode of processing daily 100 sheets of quarter size (10×12 inches) film.

Processing conditions are shown below.

| | Temp. | Time | Replenishment/ quarter size sheet |
|---|---|---|---|
| Development | 35° C. | 12 sec. | 10 ml |
| Fixation | 32° C. | 12 sec. | 15 ml |
| Washing | 25° C. | 10 sec. | — |
| Drying | 55° C. | 12 sec. | — |
| Total | — | 46 sec. | — |

The washing water was city water.

Example 4

Seed crystal formulation

Emulsion T-11

To an aqueous solution containing 0.8 g of low molecular weight gelatin (average molecular weight 15,000) and 1.2 g of potassium bromide in 1.5 liters of water and kept at 30° C., 2 g of grafted polyalkylene oxide polymer having a molecular weight of 30,000 (Compound A-21) was added. With stirring, an aqueous solution containing 18 g of silver nitrate and an aqueous solution containing 12.6 g of potassium bromide and 2.4 g of gelatin (average molecular weight 15,000) were added over 60 seconds by the double jet method. An aqueous solution containing 10 g of potassium bromide was then added to the solution, which was heated to 500C over 20 minutes. Thereafter, 1 ml of an aqueous solution of 1N sodium hydroxide was added. Subsequently, an aqueous solution of 200 g silver nitrate and an aqueous solution of 138 g potassium bromide were added over 32 minutes by the controlled double jet method while keeping pAg 8.2. The flow rate was accelerated such that the flow rate at the end of addition was 6.8 times the flow rate at the start of addition. After the solution was maintained at the temperature for 8 minutes for physical ripening, the temperature was lowered to 35° C. whereupon the soluble salts were removed by flocculation. The temperature was then raised to 40° C. whereupon 50 g of gelatin, 4.7 g of phenoxyethanol, and 1 mg of sodium thiosulfonate were added to the solution, which was adjusted to pH 5.7 with sodium hydroxide. Subsequent quench solidification yielded an emulsion T-11.

The thus obtained grains T-11 were tabular grains having a sphere equivalent diameter of 0.23±0.03 um and a thickness of 0.1 μm on the total number average.

Emulsion F-11

To 840 ml of water was added 24 g of gelatin. To the solution kept at 74° C. was added 20 g of seed crystals (emulsion T-11). After 3 minutes from the addition, 2.6 g of potassium bromide was added. Thereafter, an aqueous solution containing 32.7 g of silver nitrate and 188 ml of a halide solution containing 22.3 g of KBr and 0.63 g of KI were added over 25 minutes to effect a first stage of growth. At this stage, the flow rate was constant. After 10 mg of sodium ethylthiosulfonate was added, 0.9 mg of thiourea dioxide was added. While keeping pAg 8.00, an aqueous solution containing 161.5 g of silver nitrate and a halide solution containing 110 g of KBr and 3.15 g of KI were added over 50 minutes to effect a second stage of growth. At this stage, the flow rate was accelerated such that the flow rate at the end of addition was 5.7 times the flow rate at the start of addition. At the end of addition, 12 ml of 1N potassium thiocyanate solution was added.

After the solution was maintained at the temperature for 5 minutes for physical ripening, the temperature was lowered to 35° C. whereupon the soluble salts were removed by flocculation. The temperature was then raised to 40° C. whereupon 61 g of gelatin, 3.3 g of phenoxyethanol, and a thickener were added to the solution, which was adjusted to pH 6.1 and pAg 7.8 with sodium hydroxide and potassium bromide.

The emulsion thus prepared was heated at 50° C. and 4.8 mg of sodium ethylthiosulfonate was added. After 2 minutes, 150 mg of 4-hydroxy-6-methyl-1,3,3a,7-tetraazaindene was added. After 4 minutes, 353 mg of compound A-1 was added as a sensitizing dye, and 2.2 mg of chloroauric acid and 73 mg of potassium thiocyanate were then added, and 1 mg of sodium thiosulfate and 1.8 mg of selenium compound A-3 were further added. The solution was ripened for 27 minutes. Thereafter, 22 mg of sodium sulfite was added to the solution, which was further ripened. After 40 minutes, 1.8 g of 4-hydroxy-6-methyl-1,3,3a,7-tetraazaindene was added to the solution. Subsequent quench solidification yielded an emulsion F-11.

In this emulsion, grains having an aspect ratio of at least 5 accounted for 80% of the total projected area of the entire grains. For all the grains, the emulsion had a mean projected area diameter of 1.25 μm with a coefficient of variation of 28%, a mean thickness of 0.2 μm, and a mean aspect ratio of 7.

Emulsion F-12

Emulsion F-12 was the same as emulsion F-11 except that compound A-24 was added as the sensitizing dye upon post ripening. The amount of the dye added was the same.

Emulsion G-11

Emulsion G-11 was the same as emulsion F-11 except that the second stage of growth was done at pAg 7.5.

In this emulsion, grains having an aspect ratio of up to 7 accounted for 80% of the total projected area of the entire grains. For all the grains, the emulsion had a mean projected area diameter of 0.9 μm with a coefficient of variation of 23%, a mean thickness of 0.3 μm, and a mean aspect ratio of 4.8.

Emulsion G-12

Emulsion G-12 was the same as emulsion G-11 except that compound A-24 was added as the sensitizing dye upon post ripening. The amount of the dye added was the same.

Emulsion H-11

A reactor was charged with 1 liter of water, 4 g of sodium chloride, 4 g of potassium iodide, and 20 g of gelatin and kept at 70° C. With stirring, 400 ml of an aqueous solution containing 83 g of silver nitrate and 190 ml of an aqueous solution containing 57 g of potassium bromide were added over 16 minutes by the double jet method. An aqueous solution containing 0.1 to 0.85 mol of ammonia was added and then, 250 ml of an aqueous solution containing 123 g of silver nitrate and 275 ml of an aqueous solution containing 82.5 g of potassium bromide were added over 20 minutes by the double jet method. The solution was maintained at the temperature for 18 minutes for physical ripening. After neutralization with aqueous acetic acid, the temperature was lowered to 35° C. whereupon the soluble salts were removed by flocculation. The temperature was then raised to 40° C. whereupon 23.7 ml of 50% (w/v) trimethylol propane, 42 mg of proxisel, 32.5 g of gelatin, and a thickener were added to the solution, which was adjusted to pH 6.6 with sodium hydroxide. After the thus prepared emulsion was heated to 49° C., 41 mg of 4-hydroxy-6-methyl-1,3,3a,7-tetraazaindene, 120 mg of compound A-1 as a sensitizing dye, 0.93 mg of chloroauric acid, and 165 mg of potassium thiocyanate were added thereto. After 15 minutes, 25 mg of 4,7-dithia-1,10-decane diol was added. After 10 minutes, 2.6 mg of sodium thiosulfate and 0.9 mg of selenium compound A-3 were further added. After 90 minutes, 1.76 g of 4-hydroxy-6-methyl-1,3,3a,7-tetraazaindene was added, followed by quench solidification. The crystal habit included a shape of blunt tetradecahedron and a mean grain size of 0.8 μm.

Emulsion H-12

Emulsion H-12 was the same as emulsion H-11 except that compound A-24 was added as the sensitizing dye upon post ripening. The amount of the dye added was the same.

Preparation of emulsion coating solution 1

An emulsion coating solution 1 was prepared by adding the following chemicals to the chemically sensitized emulsion in an amount per mol of the silver halide.

| | |
|---|---|
| Gelatin (including gelatin in emulsion) | 104 g |
| Dextran (Mw = 39,000) | 19 g |
| Sodium polystyrenesulfonate (Mw = 600,000) | 1.2 g |
| Compound A-4 | 46 mg |
| Compound A-5 | 8.9 g |
| Snowtex C | 5.7 g |
| Compound A-7 | 13 mg |
| Compound A-6 | 88 mg |
| Compound A-9 (dyestuff emulsion (a)) | 600 mg |
| Ethyl acrylate/methacrylic acid (97/3) copolymer latex | 3.9 g |
| Hardener | 1.4 g |

Preparation of emulsion coating solution 2

An emulsion coating solution 2 was prepared by adding the following chemicals to the chemically sensitized emulsion in an amount per mol of the silver halide.

| | |
|---|---|
| Gelatin (including gelatin in emulsion) | 104 g |
| Dextran (Mw = 39,000) | 19 g |
| Sodium polystyrenesulfonate (Mw = 600,000) | 1.2 g |
| Compound A-4 | 46 mg |
| Compound A-5 | 8.9 g |

-continued

| | |
|---|---|
| Snowtex C | 5.7 g |
| Compound A-7 | 13 mg |
| Compound A-6 | 88 mg |
| Compound A-9 (dyestuff emulsion (a)) | 600 mg |
| Compound A-22* | 20 mg |
| Ethyl acrylate/methacrylic acid (97/3) copolymer latex | 3.9 g |
| Hardener | 1.4 g |

*Compound A-22 was added as a 0.2% aqueous solution.

Preparation of emulsion coating solution 3

An emulsion coating solution 3 was prepared by adding the following chemicals to the chemically sensitized emulsion in an amount per mol of the silver halide.

| | |
|---|---|
| Gelatin (including gelatin in emulsion) | 104 g |
| Dextran (Mw = 39,000) | 19 g |
| Sodium polystyrenesulfonate (Mw = 600,000) | 1.2 g |
| Compound A-4 | 46 mg |
| Compound A-5 | 8.9 g |
| Snowtex C | 5.7 g |
| Compound A-7 | 13 mg |
| Compound A-6 | 88 mg |
| Compound A-9 (dyestuff emulsion (a)) | 600 mg |
| Dyestuff dispersion B (dyestuff solids) | 508 mg |
| Ethyl acrylate/methacrylic acid (97/3) copolymer latex | 3.9 g |
| Hardener | 1.4 g |

Preparation of dyestuff emulsion (a)

In 333 g of ethyl acetate, 60 g of compound A-9, 62.8 g of 2,4-diaminophenol, and 62.8 g of dicyclohexylphthalate were dissolved at 60° C. Then 65 ml of a 5% aqueous solution of sodium dodecylbenzenesulfonate, 94 g of gelatin, and 581 ml of water were added. Using a dissolver, the contents were emulsified and dispersed at 60° C. for 30 minutes.

Then 2 g of methyl p-hydroxybenzoate and 6 liters of water were added to the solution, which was cooled to 40° C. Using a ultrafiltration laboratory module ACP1050 by Asahi Chemicals K.K., the solution was concentrated until a total weight of 2 kg was reached. Adding 1 g of methyl p-hydroxy-benzoate yielded dyestuff emulsion (a).

It is noted that dyestuff dispersion B was prepared by the same procedure as that for the undercoat layer (described later).

Preparation of surface Protective layer coating solution A

A coating solution for a surface protective layer was prepared by blending the following components such that they were coated in the following coverage.

| | |
|---|---|
| Gelatin | 780 mg/m$^2$ |
| Sodium polyacrylate (Mw = 400,000) | 25 mg/m$^2$ |
| Compound A-2 | 43 mg/m$^2$ |
| Compound A-10 | 18 mg/m$^2$ |
| Compound A-11 | 45 mg/m$^2$ |
| Compound A-13 | 0.9 mg/m$^2$ |
| Compound A-15 | 5 mg/m$^2$ |
| Compound A-20 | 26 mg/m$^2$ |
| Polymethylmethacrylate (mean particle size 2.5 μm) | 87 mg/m$^2$ |
| Proxisel | 0.5 mg/m$^2$ |
| Potassium polystyrenesulfonate (Mw = 600,000) | 0.9 mg/m$^2$ |
| Compound A-12 | 2 mg/m$^2$ |
| Compound A-14 (adjusted to pH 6.8 with NaOH) | 5 mg/m$^2$ |

Preparation of surface protective layer coating solution B

A coating solution for a surface protective layer was prepared by blending the following components such that they were coated in the following coverage.

| | |
|---|---|
| Gelatin | 780 mg/m$^2$ |
| Sodium polyacrylate (Mw = 400,000) | 25 mg/m$^2$ |
| Compound A-2 | 43 mg/m$^2$ |
| Compound A-10 | 18 mg/m$^2$ |
| Compound A-11 | 45 mg/m$^2$ |
| Compound A-13 | 0.9 mg/m$^2$ |
| Compound A-15 | 5 mg/m$^2$ |
| Compound A-20 | 26 mg/m$^2$ |
| Dyestuff dispersion B (dyestuff solids) | 8 mg/m$^2$ |
| Polymethylmethacrylate (mean particle size 2.5 $\mu$m) | 87 mg/m$^2$ |
| Proxisel | 0.5 mg/m$^2$ |
| Potassium polystyrenesulfonate (Mw = 600,000) | 0.9 mg/m$^2$ |
| Compound A-12 | 2 mg/m$^2$ |
| Compound A-14 (adjusted to pH 6.8 with NaOH) | 5 mg/m$^2$ |

Preparation of support (1) Preparation of dyestuff dispersion B for undercoat layer Compound A-17 was milled in a ball mill by the method described in JP-A 197943/1988. More specifically, a 2-liter ball mill was charged with 434 ml of water and 791 ml of an aqueous solution of 6.7% surfactant Triton® TX-200 (by Rohm & Haas). To the solution were added 20 g of the dyestuff and 400 ml of zirconium oxide ($ZrO_2$) beads with a diameter 2 mm. The contents were milled for 4 days. The contents were then combined with 160 g of a 12.5% gelatin aqueous solution. After deaeration, the $ZrO_2$ beads were removed from the mixture by filtration. On analysis of the thus obtained dyestuff dispersion, the dyestuff had been pulverized so as to have a wide particle size distribution ranging from 0.05 $\mu$m to 1.15 $\mu$m and a mean particle size of 0.37 $\mu$m. Subsequent centrifugation removed dyestuff particles with a diameter of more than 0.9 $\mu$m. A dyestuff dispersion B was obtained in this way.

(2) Preparation of dyestuff dispersion C for undercoat layer

Compound A-23 was milled in a ball mill by the method described in JP-A 197943/1988. More specifically, a 2-liter ball mill was charged with 434 ml of water and 791 ml of an aqueous solution of 6.7% surfactant Triton® TX-200 (by Rohm & Haas). To the solution were added 20 g of the dyestuff and 400 ml of zirconium oxide ($ZrO_2$) beads with a diameter 2 mm. The contents were milled for 4 days. The contents were then combined with 160 g of a 12.5% gelatin aqueous solution. After deaeration, the $ZrO_2$ beads were removed from the mixture by filtration. On analysis of the thus obtained dyestuff dispersion, the dyestuff had been pulverized so as to have a wide particle size distribution ranging from 0.05 $\mu$m to 1.15 $\mu$m and a mean particle size of 0.37 $\mu$m. Subsequent centrifugation removed dyestuff particles with a diameter of more than 0.9 $\mu$m. A dyestuff dispersion C was obtained in this way.

(3) Preparation of support

A biaxially oriented polyethylene terephthalate film of 175 $\mu$m thick was subject to a corona discharge. A first undercoat layer of the composition shown below was coated on one surface of the film to a coverage of 4.9 ml/m$^2$ by a wire bar coater and dried at 185° C. for one minute. The first undercoat layer was similarly formed on the other surface of the film. The polyethylene terephthalate used contained 0.04% by weight of compound A-9.

| | |
|---|---|
| Butadiene-styrene copolymer latex (solids 40%, butadiene/styrene weight ratio = 31/69) | 158 ml |
| 4% sodium 2,4-dichloro-6-hydroxy-s-triazine solution | 41 ml |
| Distilled water | 801 ml |

The latex contained 0.4% by weight based on the latex solids of compound A-18 as an emulsifying dispersant.

(4) Coating of undercoat layer

Support 1

Second undercoat layers of the composition shown below were coated on the first undercoat layers on the opposite surfaces of the film one by one side to the following coverage by a wire bar coater and dried at 55° C.

| | |
|---|---|
| Gelatin | 80 mg/m$^2$ |
| Dye dispersion B (as dyestuff solids) | 8 mg/m$^2$ |
| Compound A-19 | 1.8 mg/m$^2$ |
| Compound A-16 | 0.27 mg/m$^2$ |
| Matte agent: polymethyl methacrylate, mean particle size 2.5 $\mu$m | 2.5 mg/m$^2$ |

This support is designated support 1.

Support 2

Second undercoat layers of the composition shown below were coated on the first undercoat layers on the opposite surfaces of the film one by one side to the following coverage by a wire bar coater and dried at 55° C.

| | |
|---|---|
| Gelatin | 80 mg/m$^2$ |
| Dye dispersion C (as dyestuff solids) | 8 mg/m$^2$ |
| Compound A-19 | 1.8 mg/m$^2$ |
| Compound A-16 | 0.27 mg/m$^2$ |
| Matte agent: polymethyl methacrylate, mean particle size 2.5 $\mu$m | 2.5 mg/m$^2$ |

This support is designated support 2.

Support 3

It was prepared by the same procedure as supports 1 and 2 except that the coating solution contained neither dyestuff dispersion B nor C.

Preparation of photographic material

The emulsion layer and the surface protective layer were coated to both the surfaces of the thus prepared support by the co-extrusion method so as to give a silver coverage of 1.7 g/m$^2$ per surface, obtaining a coated sample of photographic material.

A series of coated samples were prepared in this way while changing the combination of emulsion, support and emulsion coating formulation as shown in Table 8.

The compounds used herein are identified below.

Compound A-1

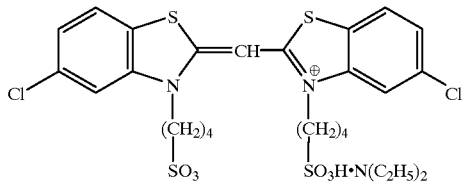

-continued
Compound A-2
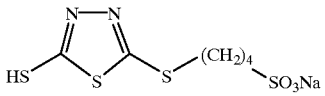
Compound A-3
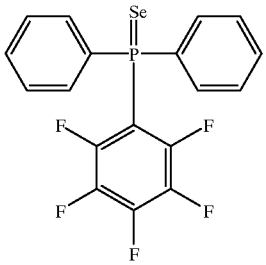
Compound A-4
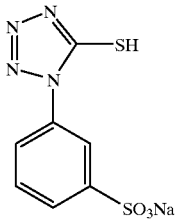
Compound A-5
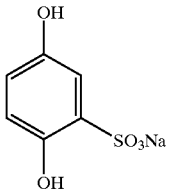
Compound A-6
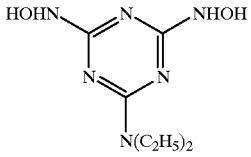
Compound A-7
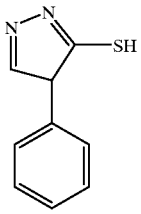
Compound A-8
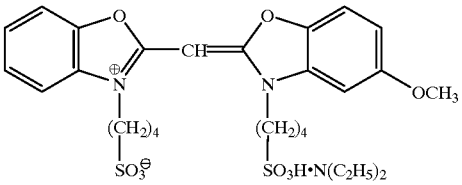
-continued
Compound A-9
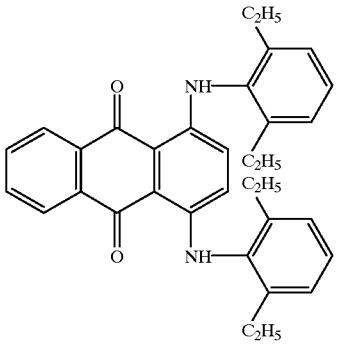
Compound A-10
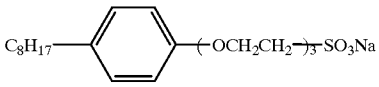
Compound A-11
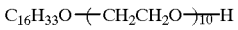
Compound A-12
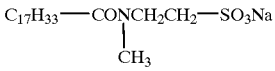
Compound A-13
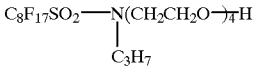
Compound A-14
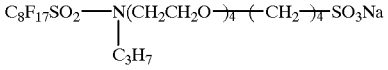
Compound A-15
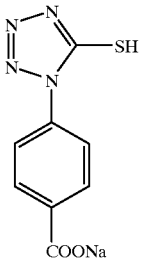
Compound A-16
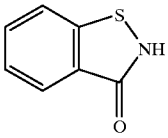
Compound A-17
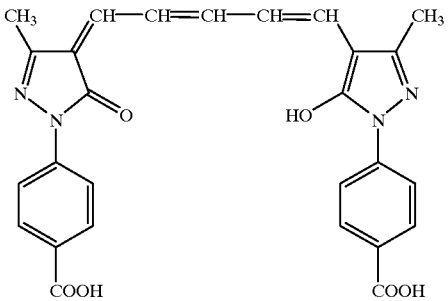

-continued

Compound A-18

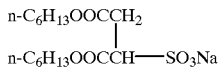

Compound A-19

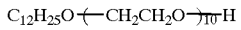

Compound A-20

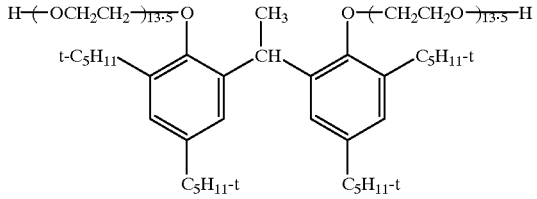

Compound A-21

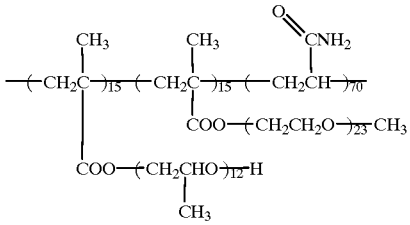

Compound A-22

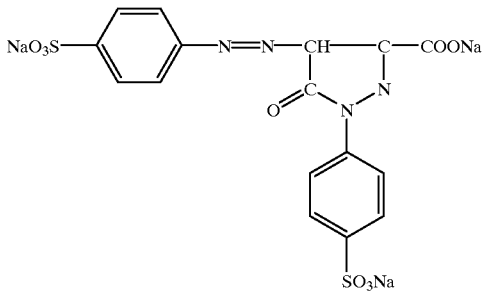

Compound A-23

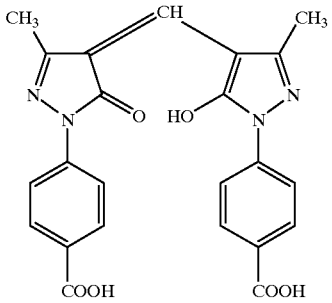

-continued

Compound A-24

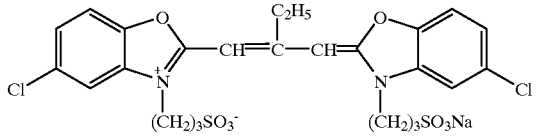

Photographic test

Each coated sample was set in Hi-Screen B2 having a center luminous wavelength of 430 nm (by Kyokko K.K.) and exposed for 100 msec. at an X-ray voltage of 80 kV and a current of 160 mA. The exposed sample was developed with a developer (1) of the formulation shown below at 35° C. for 8 seconds, and thereafter, fixed, washed with water and dried.

| Developer (1) | |
|---|---|
| 1-phenyl-3-pyrazolidone | 1.5 g |
| Hydroquinone | 30 g |
| 5-nitroindazole | 0.25 g |
| Potassium bromide | 3.0 g |
| Sodium sulfite anhydride | 50 g |
| Sodium hydroxide | 30 g |
| Boric acid | 5 g |
| Glutaraldehyde | 10 g |
| Water to make | 1 liter |
| (adjusted to pH 10.2) | |

Each of the coated samples was examined for sensitivity, sharpness and screen soilure.

Sensitivity

The photographic material was exposed using conventional screens on both sides. Sensitivity is defined as an inverse of an exposure necessary to give a density of the fog density (Fog)+1.0 and expressed in a relative value based on 100 for sample No. 101 using support 1 and emulsion F-11.

Sharpness

Sharpness was compared by sandwiching the coated sample between intensifying screens (Hi-Screen B2) and photographing a chest phantom positioned 2 cm apart from an X-ray source. Imaging conditions included 80 kV and 160 mA while the irradiating time was adjusted so as to provide a lung area density of 1.5. The exposed sample was developed as above. With the sample set on a view box, sharpness was rated on a three-point scale from the sharpness of the lung area and the visualization of the mediastinal area. The sample was rated "O" when its sharpness is good and on a practically satisfactory level, "Δ" when its sharpness is somewhat inferior, but on a practically acceptable level, and "X" when its sharpness is inferior and on a practically unacceptable level.

Screen soilure

Screen soilure was tested as follows, by repeatedly contacting the film with a screen and visually inspecting whether the screen was soiled or not. More specifically, the coated samples was cut to a size of 279 mm×354 mm. The sample was set in an auto-feeder-equipped film changer Medix 130XF (by Hitachi K.K.). The screens used were Hi-Screen B2. New screens were attached before the start of the test. Now that the system was ready, 10,000 sheets were continuously photographed. At the end of photographing, the screen was visually observed for soilure at its edge where the film had come in close contact with the screen. The rating was "O" when the screen was clean and "X" when the screen was soiled.

The results are shown in Table 8.

TABLE 8

| Coated sample No. | Emulsion | Support | Coating formulation | Protective formulation | Sensitivity | Sharpness | Screen soilure |
|---|---|---|---|---|---|---|---|
| 101 | F-11 | 1 | 1 | A | 100 | ○ | ○ |
| 102 | F-12 | 1 | 1 | A | 80 | Δ | ○ |
| 103 | G-11 | 1 | 1 | A | 80 | ○ | ○ |
| 104 | G-12 | 1 | 1 | A | 64 | Δ | ○ |
| 105 | H-11 | 1 | 1 | A | 70 | ○ | ○ |
| 106 | H-12 | 1 | 1 | A | 56 | Δ | ○ |
| 107 | F-11 | 2 | 1 | A | 100 | ○ | ○ |
| 108 | F-12 | 2 | 1 | A | 80 | Δ | ○ |
| 109 | G-11 | 2 | 1 | A | 80 | ○ | ○ |
| 110 | G-12 | 2 | 1 | A | 64 | Δ | ○ |
| 111 | H-11 | 2 | 1 | A | 70 | ○ | ○ |
| 112 | H-12 | 2 | 1 | A | 56 | Δ | ○ |
| 113 | F-11 | 3 | 1 | A | 110 | X | ○ |
| 114 | F-12 | 3 | 1 | A | 88 | X | ○ |
| 115 | G-11 | 3 | 1 | A | 88 | X | ○ |
| 116 | G-12 | 3 | 1 | A | 71 | X | ○ |
| 117 | H-11 | 3 | 1 | A | 77 | X | ○ |
| 118 | H-12 | 3 | 1 | A | 61 | X | ○ |
| 119 | F-11 | 3 | 2 | A | 100 | Δ | X |
| 120 | F-11 | 3 | 1 | B | 80 | ○ | X |
| 121 | F-11 | 3 | 3 | A | 80 | ○ | ○ |

The data are summarized below.

Sample Nos. 101 to 106 commonly use support 1 and coating formulation 1, but are different in emulsion species. As compared with F-11, samples using emulsions F-12, G-11, G-12, H-11 and H-12 exhibit low sensitivity. Samples using emulsions F-12, G-12 and H-12 containing compound A-24 as the sensitizing dye also exhibit somewhat low sharpness.

Sample Nos. 107 to 112 commonly use support 2 and coating formulation 1, but are different in emulsion species. As compared with F-11, samples using emulsions F-12, G-11, G-12, H-11 and H-12 exhibit low sensitivity. Samples using emulsions F-12, G-12 and H-12 containing compound A-24 as the sensitizing dye also exhibit somewhat low sharpness.

Sample Nos. 113 to 118 commonly use support 3 and coating formulation 1, but are different in emulsion species. All these samples lack sharpness.

Sample No. 119 uses support 3 not containing the solid dispersion of dyestuff and coating formulation 2 having the water-soluble dyestuff dissolved and added. Sensitivity is equivalent, but screen soilure is serious and sharpness is somewhat low.

The foregoing sample Nos. 101 to 119 all use protective formulation A.

Sample No. 120 uses support 3 not containing the solid dispersion of dyestuff, in combination with coating formulation 1 and protective formulation B. Sharpness is equivalent, but sensitivity lowers 20% and screen soilure is serious.

Sample No. 121 uses support 3 not containing the solid dispersion of dyestuff, in combination with coating formulation 3 and protective formulation A. Sharpness and screen soilure are equivalent, but sensitivity lowers 20%.

It is thus evident that the combinations which can ensure satisfactory results of sensitivity, sharpness and screen soilure are only sample Nos. 101 and 107.

Example 5

Samples were prepared by the same procedure as sample Nos. 101 and 107 in Example 4 except that an emulsion coating solution containing 150 mg of compound A-8 was used. These samples were tested as in Example 4, finding that these samples are satisfactory in sensitivity, sharpness and screen soilure.

There has been described a silver halide photographic material which is improved in sensitivity and sharpness and effective for restraining dye stain. It maintains high sensitivity and eliminates image unsharpness even when combined with a screen having a luminous peak in the range of 300 to 500 nm and subject to rapid processing. It does not soil the screen.

Although some preferred embodiments have been described, many modifications and variations may be made thereto in the light of the above teachings. It is therefore to be understood that within the scope of the appended claims, the invention may be practiced otherwise than as specifically described.

We claim:

1. A silver halide photographic material comprising at least one photosensitive silver halide emulsion layer and at least one non-photosensitive hydrophilic colloid layer on a support, wherein the silver coverage per surface is in the range of 1.3 to 2.0 $q/m^2$, the silver halide emulsion layer contains silver halide grains wherein tabular silver halide grains having an aspect ratio of at least 5 account for at least 50% of the entire projected area of silver halide grains, and the silver halide grains have been grown on pure silver bromide grains or silver chlorobromide grains as nuclei so as to form silver iodobromide or silver chloroiodobromide having a silver iodide content of 0.1 to 3.20 mol % at the end of growth, wherein the pure silver bromide grains or silver chlorobromide grains serving as nuclei have been prepared using a vinyl polymer having recurring units derived from at least one monomer of the following formula (2):

(2)

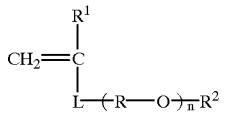

wherein R is an alkylene group having 3 to 10 carbon atoms, letter n represents an average number of recurring units from 4 to 200, $R^1$ is hydrogen or a lower alkyl group, $R^2$ is hydrogen or a monovalent substituent, and L is a divalent linkage group.

2. The photographic material of claim 1 wherein the amount of said polymer having recurring units of formula (2) is 0.1 to 20 g per mol of silver.

3. The photographic material of claim 1 wherein said nuclei are silver chlorobrimide grains or silver bromide grains having a silver chloride content of less than 20 mol %.

4. The photographic material of claim 1 wherein said tabular silver halide grains having an aspect ratio of at least 5 account for 70 to 100% of the entire projected area of silver halide grains.

5. The photographic material of claim 1 wherein upon exposure of the photographic material, a screen having a luminous wavelength in the range of 300 to 500 nm is used.

6. The photographic material of claim 1 wherein the silver halide grains have been sensitized with selenium.

7. A silver halide photographic material according to claim 1 comprising at least one photosensitive silver halide emulsion layer and at least two non-photosensitive hydrophilic colloid layers on a support, wherein upon exposure of the photographic material, a screen having a luminous wavelength in the range of 300 to 500 nm is used, the silver halide grains have been spectrally sensitized with at least one compound of the general formula (I):

(I)

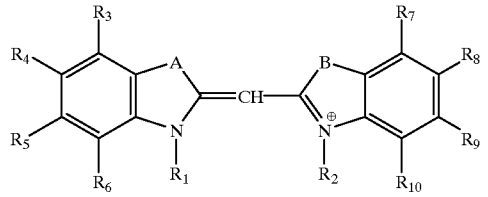

wherein each of A and B is an oxygen atom, sulfur atom or imino group, each of $R_1$ and $R_2$ is a sulfoalkyl group, and $R_3$ to $R_{10}$ are independently selected from the class consisting of hydrogen, halogen, alkyl, alkenyl, alkoxy, aryl and heterocyclic groups, and at least one non-photosensitive hydrophilic colloid layer using a solid particle dispersion of a dyestuff is coated under said photosensitive silver halide emulsion layer.

8. The photographic material of claim 7 wherein the solid particle dispersion of a dyestuff is a solid particle dispersion of a dyestuff of the general formula (FA):

$$D—(X)_{y1} \quad \text{(FA)}$$

wherein D is a group derived from a compound having a chromophore, X is dissociatable proton directly bonding to D, a group having such dissociatable proton, dissociatable proton having attached thereto a divalent linkage group bonding to D or a group having such dissociatable proton, and letter y1 is an integer of 1 to 7.

9. The photographic material of claim 8 wherein the dyestuff of formula (FA) is a dyestuff of the following formula (FA1), (FA2) or (FA3):

$$A_1{=}L_1{-}(L_2{=}L_3)_{p1}{-}Q \quad \text{(FA1)}$$

$$A_1{=}L_1{-}(L_2{=}L_3)_{p2}{-}A_2 \quad \text{(FA2)}$$

$$A_1{=}L_1{-}(L_2{=}L_3)_{p3}{-}B_1 \quad \text{(FA3)}$$

wherein each of $A_1$ and $A_2$ is an acidic nucleus, $B_1$ is a basic nucleus, Q is an aryl or heterocyclic group, each of $L_1$, $L_2$ and $L_3$ is a methine group, letter p1 is equal to 0, 1 or 2, each of letters p2 and p3 is equal to 0, 1, 2 or 3, with the proviso that the compounds of formulae (FA1) to (FA3) have in a molecule at least one group selected from the class consisting of a carboxylic acid group, sulfonamide group, arylsulfamoyl group, sulfonylcarbamoyl group, carbonylsulfamoyl group, enol group of an oxanol dye, and phenolic hydroxyl group, but are free of any water-soluble group other than that.

10. A method for preparing a silver halide photographic material comprising at least one photosensitive silver halide emulsion layer and at least one non-photosensitive hydrophilic colloid layer on a support, wherein the silver coverage per surface is in the range of 1.3 to 2.0 g/$m^2$, and the silver halide emulsion layer contains silver halide grains wherein tabular silver halide grains having an aspect ratio of at least 5 account for at least 50% of the entire projected area of silver halide grains, said method comprising silver halide grains preparation steps of:

forming pure silver bromide grains or silver chlorobromide grains using a vinyl polymer having recurring units derived from at least one monomer of the following formula (2):

(2)

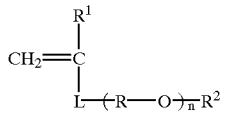

wherein R is an alkylene group having 3 to 10 carbon atoms, n represents an average number of recurring units from 4 to 200, $R^1$ is hydrogen or a lower alkyl group, $R^2$ is hydrogen or a monovalent substituent, and L is a divalent linkage group, and effecting grain growth with the pure silver bromide or chlorobromide grains serving as nuclei under such conditions as to form silver iodobromide or silver chloroiodobromide grains having a silver iodide content of 0.1 to 3.20 mol % at the end of growth.

* * * * *

UNITED STATES PATENT AND TRADEMARK OFFICE

CERTIFICATE OF CORRECTION

PATENT NO. : 6,020,118
DATED : February 1, 2000
INVENTOR(S) : Yoshihisa Hashi, et. al.

It is certified that error appears in the above-identified patent and that said Letters Patent is hereby corrected as shown below:

Title page, item [54] and col. 1, change the title to read as following:

SILVER HALIDE PHOTOGRAPHIC MATERIAL

In claim 1, line 6:

"q/m$^2$" is changed to --g/m$^2$--

Signed and Sealed this

Sixth Day of February, 2001

*Attest:*

*Attesting Officer*

Q. TODD DICKINSON

*Director of Patents and Trademarks*